US008596736B2

(12) United States Patent
Kobayashi et al.

(10) Patent No.: US 8,596,736 B2
(45) Date of Patent: Dec. 3, 2013

(54) IMAGE FORMING APPARATUS

(71) Applicants: Takeyuki Kobayashi, Kanagawa (JP); Suguru Masunaga, Kanagawa (JP)

(72) Inventors: Takeyuki Kobayashi, Kanagawa (JP); Suguru Masunaga, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/666,199

(22) Filed: Nov. 1, 2012

(65) Prior Publication Data

US 2013/0135401 A1 May 30, 2013

(30) Foreign Application Priority Data

Nov. 25, 2011 (JP) ..... 2011-258235

(51) Int. Cl.
*B41J 2/195* (2006.01)
*B41J 29/393* (2006.01)

(52) U.S. Cl.
USPC ..... 347/7; 347/19

(58) Field of Classification Search
USPC ..... 347/7, 19, 85, 86, 87
See application file for complete search history.

(56) References Cited

U.S. PATENT DOCUMENTS 7,325,908 B2 * 2/2008 Katoh et al. ..... 347/85
7,798,586 B2 * 9/2010 Watanabe ..... 347/7
7,841,706 B2 * 11/2010 Ishinaga et al. ..... 347/84
2010/0321426 A1 12/2010 Suzuki et al.
2011/0164077 A1 7/2011 Masunaga

FOREIGN PATENT DOCUMENTS

JP 2009-126049 6/2009
JP 2011-207206 10/2011

OTHER PUBLICATIONS

U.S. Appl. No. 13/467,418, filed May 9, 2012, Takeyuki Kobayashi et al.
U.S. Appl. No. 13/517,795, filed Jun. 14, 2012, Suguru Masunaga.

* cited by examiner

*Primary Examiner* — Anh T. N. Vo
(74) *Attorney, Agent, or Firm* — Cooper & Dunham LLP

(57) ABSTRACT

In an image forming apparatus, a liquid supply control processor controls to detect and store a difference amount corresponding to a displacement amount of a displacing member between a position detected by a first sensor and another position detected by a second sensor; measure a consumed liquid amount; start the liquid supply upon the consumed liquid amount reaching a predetermined threshold so as to supply the difference amount after the first sensor has detected the displacing member; and stop the liquid supply when the first sensor does not detect the displacing member before a preset predetermined time has passed. The control processor controls the image forming apparatus such that, when the liquid supply is performed without using the second sensor, using a first and second predetermined threshold times and the first threshold time is set longer than the second threshold time.

10 Claims, 20 Drawing Sheets

IMAGE FORMING APPARATUS

CROSS-REFERENCE TO RELATED APPLICATION

The present application claims priority from Japanese patent application number 2011-258235, filed on Nov. 25, 2011, the entire contents of which are incorporated by reference herein.

BACKGROUND OF THE INVENTION

1. Field of the Invention

The present invention relates to an image forming apparatus, and in particular relates to an image forming apparatus including a recording head or print head to discharge ink droplets and a head tank to supply liquid ink to the print head.

2. Description of the Related Art

As an image forming apparatus such as a printer, a facsimile machine, a copier, a plotter, and a multifunction apparatus combining capabilities of the above devices, an inkjet recording apparatus of a liquid discharging recording method employing a recording head formed of ink droplet discharging head is known.

JP-2001-207206-A discloses one type of image forming apparatus including a head tank or sub tank disposed at the recording head side to which liquid ink is supplied from a main tank during the printing operation. The head tank has a displacing member which displaces in response changes in the amount of ink remaining inside the head tank. A first sensor to detect that the displacing member is positioned at a predetermined first position is disposed at a carriage and a second sensor to detect that the displacing member is positioned at a predetermined second position is disposed at the apparatus body side. A displacement amount of the displacing member between the first position detected by the first sensor and the second position detected by the second sensor is detected and stored, and when the liquid is supplied from the main tank to the head tank without using the second sensor at the apparatus body side, after the first sensor has detected the displacing member, an amount of liquid corresponding to the difference is supplied to the head tank.

In the configuration disclosed above, a malfunction of the liquid supply might occur due to any one of several different factors, such as if the remaining amount of the liquid is small, if any trouble occurs in the fluid supply means, if the supply amount is less than the predetermined amount, or if there is a leak in the supply system.

SUMMARY OF THE INVENTION

The present invention provides an optimal image forming apparatus capable of supplying the liquid to the head tank with a fail-safe function using only a sensor on the carriage.

The image forming apparatus includes a recording head to discharge liquid droplets; a head tank to contain a liquid to be supplied to the print head; a carriage mounting the recording head and the head tank thereon; a main tank to contain a liquid to be supplied to the head tank; a fluid conveyance pump to convey the liquid from the main tank to the head tank; a liquid supply control processor to control the Liquid supply from the main tank to the head tank by driving the fluid conveyance pump; a displacing member disposed at the head tank and configured to displace depending on a remaining amount of the liquid inside the head tank; a first sensor disposed on the carriage and configured to detect the displacing member; and a second sensor disposed on the apparatus body and configured to detect the displacing member.

In the image forming apparatus, a first position detected by the first sensor is a first position at which the remaining amount of the liquid in the head tank is smaller than that at a second position detected by the second sensor; and the liquid supply control processor is configured to: detect and store a difference amount corresponding to a displacement amount of the displacing member between the first position detected by the first sensor and the second position detected by the second sensor; measure a consumed liquid amount when the displacing member displaces from the first position detected by the first sensor in the direction in which the remaining liquid amount of the head tank is reducing when supplying the liquid from the main tank to the head tank without using the second sensor; start the liquid supply upon the consumed liquid amount reaching a predetermined threshold so as to supply the difference amount after the first sensor has detected the displacing member; and stop the liquid supply when the first sensor does not detect the displacing member before a preset predetermined time has passed, when the liquid supply is performed from the main tank to the head tank without using the second sensor.

Further, the preset predetermined time includes a first predetermined threshold time and a second predetermined threshold time shorter than the first predetermined threshold time. The first threshold time is the time in which the liquid supply from the main tank to the head tank is performed while consuming the liquid in the head tank and the second threshold time is the time in which the liquid supply from the main tank to the head tank is performed without consuming the liquid in the head tank, and the first threshold time is set longer than the second threshold time.

These and other objects, features, and advantages of the present invention will become apparent upon consideration of the following description of the preferred embodiments of the present invention when taken in conjunction with the accompanying drawings.

DESCRIPTION OF THE PREFERRED EMBODIMENTS

Hereinafter, preferred embodiments of the present invention will now be described with reference to the accompanying drawings.

Figure 1:
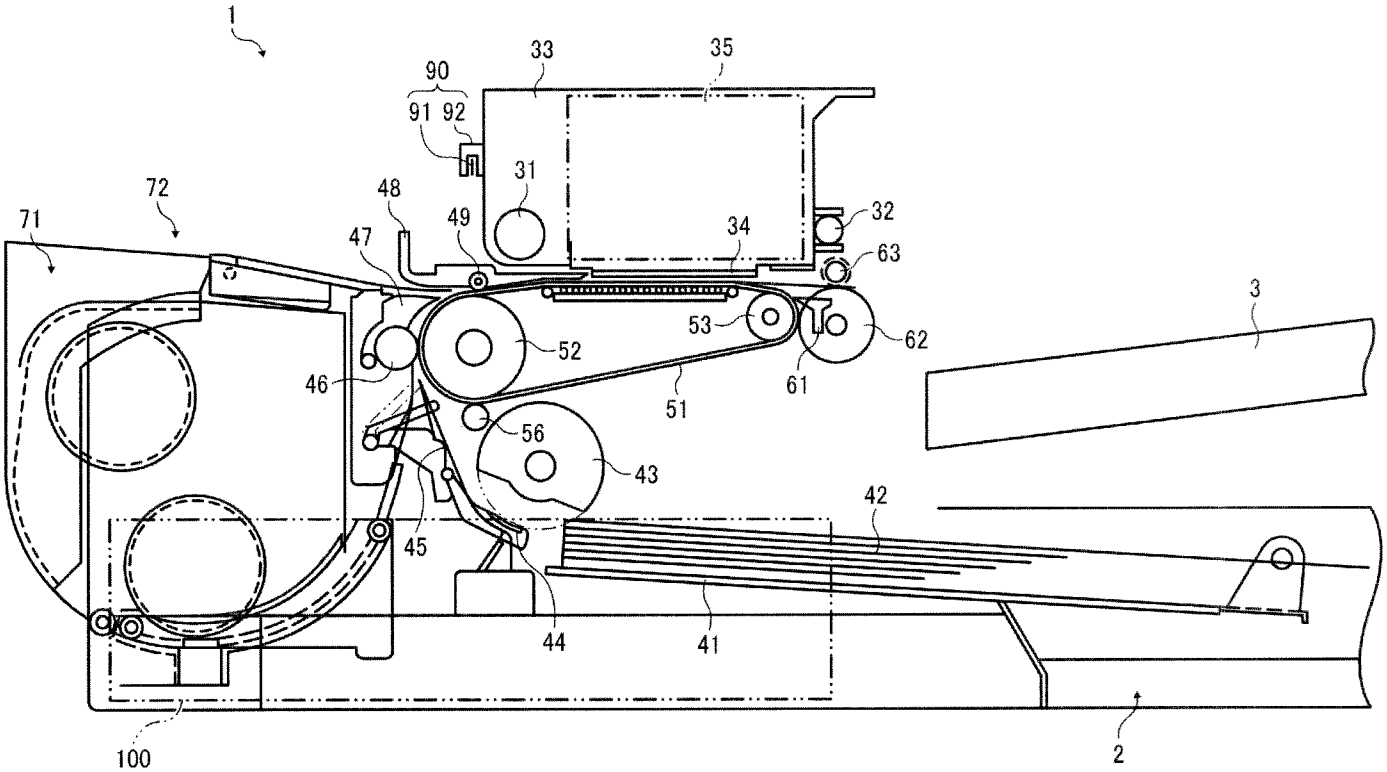
FIG. 1 is a side view of an image forming apparatus illustrating an overall configuration thereof according to an embodiment of the present invention.
Figure 2:
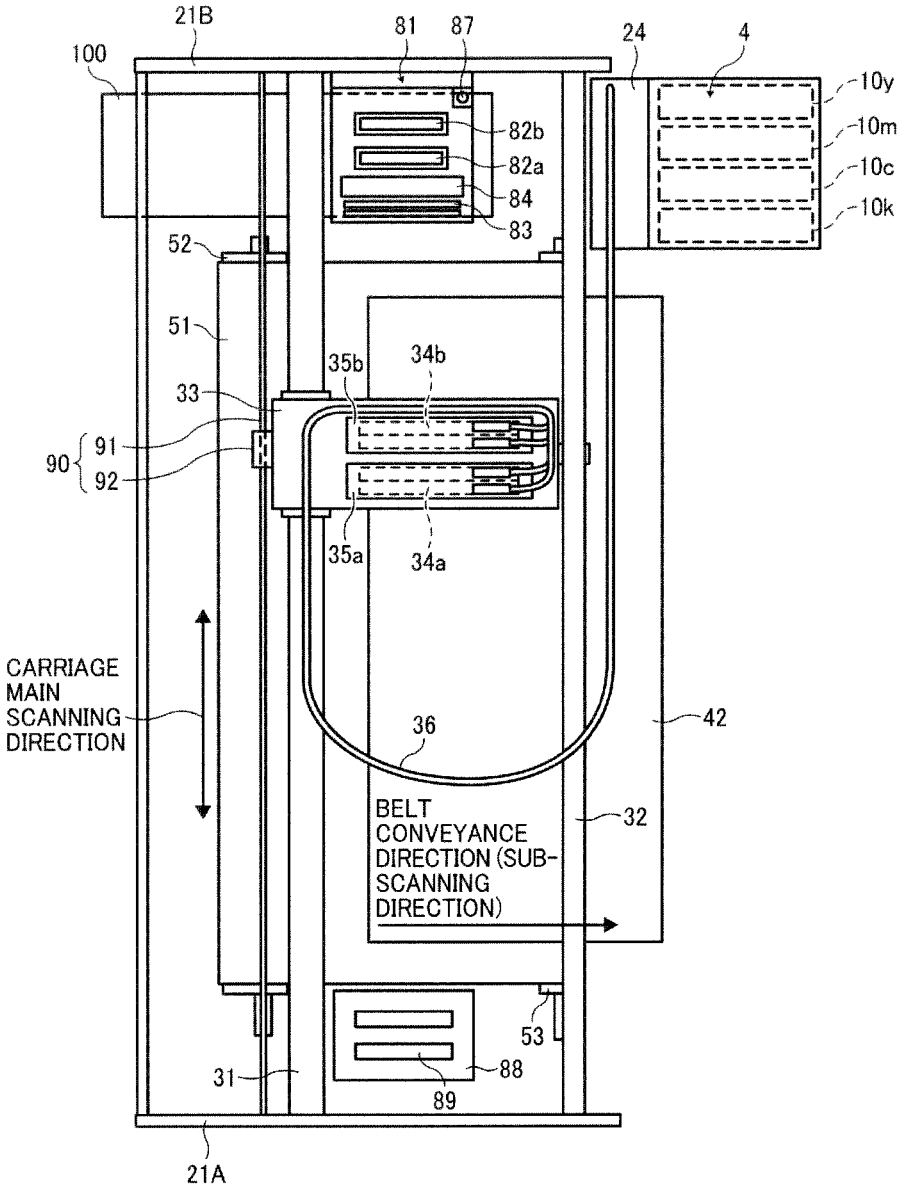
FIG. 2 is a plan view of a main part of the image forming apparatus in FIG. 1.

First, an example of an image forming apparatus according to the present invention will be described with reference to FIGS. 1 and 2. FIG. 1 is a side view of the image forming apparatus illustrating an entire structure thereof and FIG. 2 is a plan view illustrating a main part of the image forming apparatus of FIG. 1.

In the present embodiment, the image forming apparatus is a serial-type inkjet recording apparatus, including a main body 1, side plates 21A and 21B disposed at lateral sides of the main body 1, main and sub guide rods 31 and 32 horizontally mounted on the lateral side plates 21A and 21 B, and a carriage 33 held by the main and sub guide rods 31 and 32 and slidably movable in a main scanning direction by a main scanning motor, to be described later, via a timing belt.

Recording heads 34*a* and 34*b*, mounted on the carriage 33 include bifurcated recording heads 34*a* and 34*b* (collectively referred to as the recording heads 34). The recording heads 34 are formed of liquid discharging heads to discharge ink droplets of yellow (Y), cyan (C), magenta (M), and black (K) colors, respectively, and include nozzle arrays formed of a plurality of nozzles arranged in a sub-scanning direction perpendicular to the main scanning direction, with the ink droplet discharging direction oriented downward.

The recording heads 34 each include two nozzle arrays. One of the nozzle arrays of the recording head 34*a* discharges droplets of black (K) and the other discharges droplets of cyan (C) ink. One of the nozzle arrays of the recording head 34*b* discharges droplets of magenta (M) and the other discharges droplets of yellow (Y) ink, respectively.

The carriage 33 includes head tanks 35*a* and 35*b* (collectively referred to as head tanks 35), which supply ink of respective colors corresponding to each of the nozzle arrays of the recording heads 34. The head tanks 35 are used to supply ink of respective colors by a supply pump unit 24 via a supply tube 36 for each color from ink cartridges 10*y*, 10*m*, 10*c*, and 10*k*, each of which is a main tank of each color detachably mounted to a cartridge mount portion 4.

An encoder scale 91 is disposed along the main scanning direction of the carriage 33 and an encoder sensor 92 to read the encoder scale 91 is disposed on the carriage 33. The encoder scale 91 and the encoder sensor 92 form a linear encoder 90. The position of the carriage 33 in the main scanning direction (or the carriage position) and displacement amount thereof can be detected from a detection signal of the linear encoder sensor 90.

There is provided a sheet feeding portion from which sheets 42 piled on a sheet piling portion (pressure plate) 41 of a sheet feed tray 2 are conveyed. The sheet feeding portion includes a sheet feed roller 43 to separate and feed sheets 42 from the sheet piling portion 41 one by one and a separation pad 44 facing the sheet feed roller 43 and formed of a material having a high friction coefficient. The separation pad 44 is pressed against the sheet feed roller 43.

Then, in order to send the sheet 42 fed from the sheet feed portion to the lower side of the print head 34, a guide member 45 to guide the sheet 42, a counter roller 46, a conveyance guide member 47, a pressure member 48 including an end press roller 49, and a conveyance belt 51, a conveying means to electrostatically attract the fed sheet 42 and convey it at a position facing the print heads 34 are disposed.

This conveyance belt 51 is an endless belt stretching over a conveyance roller 52 and a tension roller 53, and is so configured as to rotate in a belt conveyance direction (i.e., a sub-scanning direction). In addition, a charging roller 56, which is a charging means to charge a surface of the conveyance belt 51, is provided. The charging roller 56 is disposed in contact with the surface layer of the conveyance belt 51 and is rotated accompanied by the rotation of the conveyance belt 51. The conveyance belt 51 is rotated in a belt conveyance direction by the rotation of the conveyance roller 52 driven by a sub-scanning motor, which will be described later.

Further, as a sheet ejection portion to eject the sheet 42 recorded by the recording heads 34, a separation claw 61 to separate a sheet 42 from the conveyance belt 51, a sheet discharge roller 62, and a spur 63 being a sheet discharge roller are provided. A sheet discharge tray 3 is provided underneath the sheet discharge roller 62.

A duplex unit 71 is provided detachably at a backside of the apparatus body I. This duplex unit 71 pulls in a sheet 42 which has been returned by a reverse rotation of the conveyance belt 51, reverses the sheet 42, and feeds the reversed sheet 42 again between the counter roller 46 and the conveyance belt 51. An upper surface of the duplex unit 71 is used as a manual sheet feed tray 72.

A maintenance mechanism including a maintenance means to maintain the nozzles of the recording heads 34 in good condition is provided at a non-printing area at one side in the scanning direction of the carriage 33. The maintenance mechanism 81 includes: cap members 82*a*, 82*b*: a wiper blade 83; a first dummy discharge receiver 84; and a carriage lock 87 to lock the carriage 33. The cap members 82*a*, 82*b* are provided to cap the nozzle surfaces of the recording heads 34 and are simply referred to as a cap 82 if it is not necessary to distinguish the cap members. The wiper blade 83 is a blade member to wipe the nozzle surfaces. The first dummy discharge receiver 84 receives droplets which are not used for the recording when performing a dummy discharge operation in order to discharge agglomerated recording liquid not contributing to a normal recording operation. Further, in the bottom of the maintenance mechanism 81 of the print head, a waste tank 100 to contain waste liquid generated by the maintenance operation is replaceably attached to the apparatus body.

Further, a second dummy discharge receiver 88 is disposed at a non-printing area at an opposite side in the scanning direction of the carriage 33 in order to receive droplets of recording liquid when performing a dummy discharge operation in which recording liquid having an increased viscosity during recording and not contributing to the recording is discharged. The second dummy discharge receiver 88 includes openings 89 aligned in the nozzle array direction of the print heads 34.

In the thus-configured image forming apparatus, the sheets 42 are separated and fed one by one from the sheet feed tray 2, the sheet 42 fed upward in a substantially vertical direction is guided by the guide member 45, and is conveyed while being sandwiched between the conveyance belt 51 and the counter roller 46. The leading edge of the sheet 42 is then guided by the conveyance guide member 37 and is pressed against the conveyance belt 51 by the leading end press roller 49 to change the conveyance direction by substantially 90 degrees.

At that time, an alternating voltage, which is an alternating repetition of positive and negative voltages, is applied to the charge roller 56. Thus, the conveyance belt 51 is charged in an alternating charge pattern, in which a positive charge and a negative charge are alternately applied across strips with predetermined widths in the sub-scanning direction, which is the direction of rotation of the conveyance belt 51. When the sheet 42 is fed on the thus-alternately-charged conveyance belt 51, the sheet 42 is attracted to the conveyance belt 51 and is conveyed in the sub-scanning direction by the rotation of the conveyance belt 51.

Then, the recording heads 34 are driven in response to image signals while moving the carriage 33 so as to discharge ink droplets onto the stopped sheet 42 to record a single line. After the sheet 42 is conveyed a predetermined distance, recording of a next line is performed. Upon reception of a recording end signal or a signal indicating that a trailing edge of the sheet 42 has reached the recording area, the recording operation is terminated and the sheet 42 is discharged to the sheet discharge tray 3.

When the maintenance of the print heads 34 are performed, the carriage 33 is moved to a home position opposite the maintenance mechanism 81 and capping by the cap member 82 is performed. Then, maintenance operations such as suction of nozzles and dummy discharge, in which liquid droplets not contributive to the image formation are discharged, are performed, thereby forming a quality image by a stable liquid droplet discharge.

Figure 3:
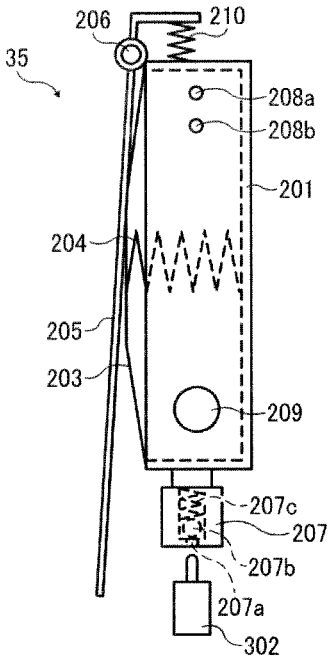
FIG. 3 is a schematic plan view illustrating an example of a head tank.
Figure 4:
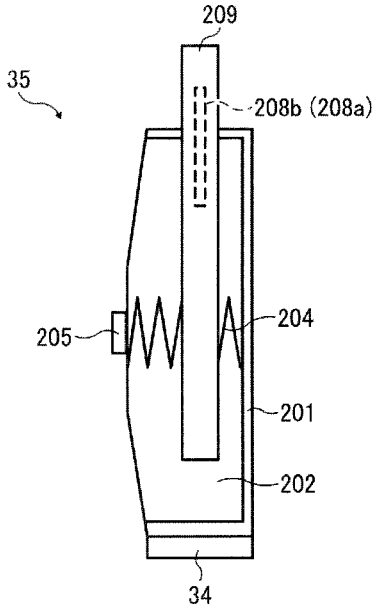
FIG. 4 is a cross-sectional view of the head tank in FIG. 3.

Next, an example of the head tank 35 will now be described with reference to FIGS. 3 and 4. FIG. 3 is a schematic plan view of the head tank 35 corresponding to one nozzle array and FIG. 4 is a schematic front view of the same.

Each head tank 35 includes a tank case 201 forming an ink container 201 and an opening. The opening of the tank case 201 is sealed with a flexible film 203 to form an ink container 202. A spring 204 as an elastic, resilient member disposed inside the tank case 201 constantly pushes the film 203 outward. Due to the resilient force of the spring 204 acting on the film 203 of the tank case 201, if the remaining amount of the ink inside the ink container 202 of the tank case 201 is reduced, a negative pressure is generated.

A displacing member 205 disposed outside the tank case 201 and configured as a feeler is hinged to a support shaft 206 at one end thereof and is pressed against the tank case 201 by the spring 210. The displacing member 205 is fixed to the film 203 with an adhesive and displaces in conjunction with a movement of the film 203. Remaining amount of the ink and negative pressure inside the head tank 35 can be obtained by detecting the displacing member 205 by a first sensor 251 disposed on the carriage 33 or by a second sensor 301 disposed on the apparatus body, both of which will be described later.

A supply port 209 through which the ink is supplied from an ink cartridge 10 is disposed at an upper part of the tank case 201 and the supply port 209 is connected to the supply tube 36. In addition, a venting unit 207 to expose an interior of the head tank 35 to the atmosphere is disposed at a side of the tank case 201. The venting unit 207 includes a venting path 207*a* communicating to an interior of the head tank 35, a valve 207*b* configured to open or close the venting path 207*a*, and a spring 207*c* to press and open the valve 207*b*. When a venting solenoid 302 disposed at the apparatus body presses and opens the valve 207*b*, the air inside the head tank 35 is released into the atmosphere.

Electrode pins 208*a* and 208*b* are also disposed to detect a height of the liquid ink inside the head tank 35. Because ink is electrically conductive, when the ink reaches the electrode pins 208*a* and 208*b*, electric current flows between the electrode pins 208*a* and 208*b* and the electrical resistance across the electrode pins 208*a* and 208*b* changes. With this structure, that the height of the liquid ink level inside the head tank 35 has been reduced to a predetermined height or below, or that the air amount inside the head tank 35 has increased to a predetermined amount, can be detected.

Figure 5:
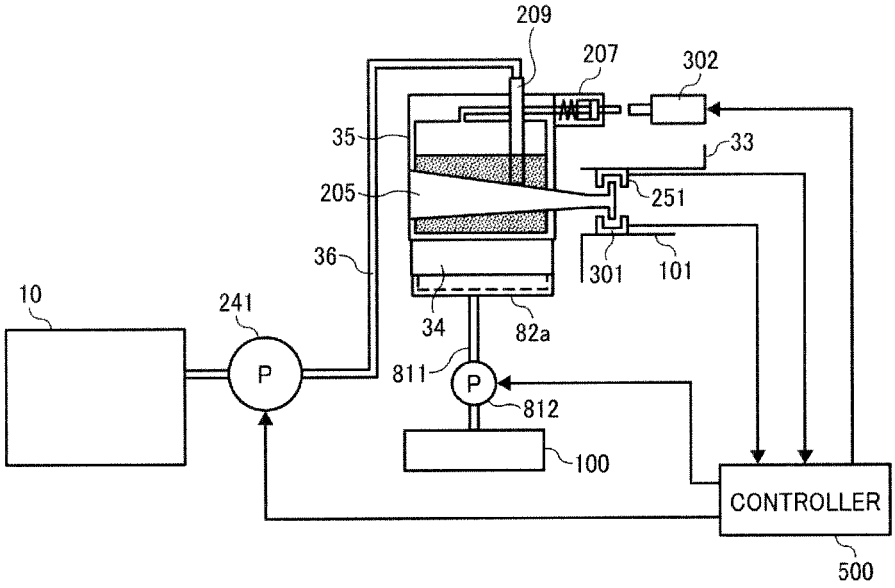
FIG. 5 is a schematic explanatory view illustrating an ink supply and discharge system.

Next, an ink supply and discharge system in the present image forming apparatus will now be described with reference to FIG. 5.

First, supplying the ink from the ink cartridge 10 ("main tank", hereinafter) to the head tank 35 is performed via the supply tube 36 by a fluid conveyance pump 241, being a fluid conveyance means of the supply pump unit 24. The fluid conveyance pump 241 is a reversible pump formed of a tube pump and performs both an operation to supply ink from the ink cartridge 10 to the head tank 35 and an operation to return ink from the head tank 35 to the ink cartridge 10.

Further, the maintenance mechanism 81 includes a suction cap 82*a* to cap the nozzle surface of the print head 34 and a suction pump 812 connected to the suction cap 82*a*. When the suction pump 812 is driven in a state that the nozzle surface is capped with the cap 82*a*, the ink is sucked from the nozzle via the suction tube 811 and the ink inside the head tank 35 can be sucked. The sucked waste ink is discharged to the waste tank 100.

In addition, a venting solenoid 302 disposed on the apparatus body serves to open or close the venting unit 207 of the head tank 35. By operating the venting solenoid 302, the venting unit 207 can be released to the atmosphere.

The first sensor 251, an optical sensor configured to detect the displacing member 205 is disposed on the carriage 33, and the second sensor 301, an optical sensor configured to detect the displacing member 205 is disposed on the apparatus body. The ink supplying operation to the head tank 35 is controlled by using detection results of these first and second sensors 251 and 301.

The driving of the fluid conveyance pump 241, venting solenoid 302, and suction pump 812 and the ink supply control operation according to the present invention are controlled by a controller 500.

Figure 6:
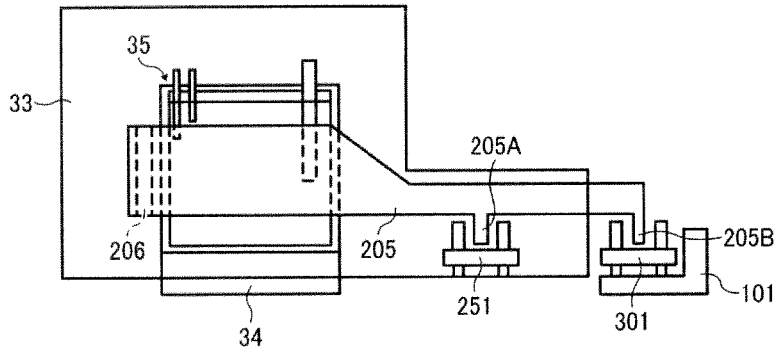
FIG. 6 is a view illustrating first exemplary positions of first and second sensors.
Figure 7:
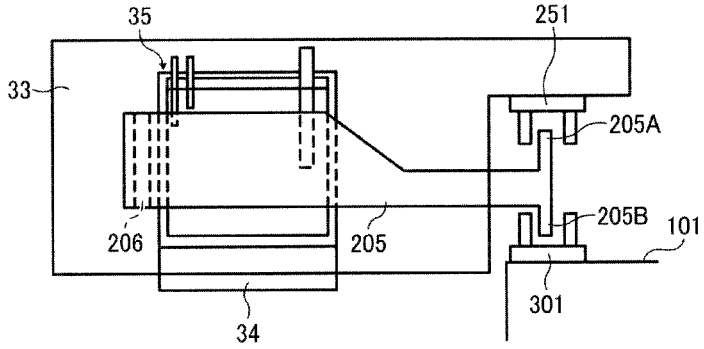
FIG. 7 is a view illustrating second exemplary positions of the first and second sensors.

FIGS. 6 and 7 are views illustrating the first and second sensors which are disposed at different positions. FIGS. 6 and 7 are side views illustrating examples of positions of the first and second sensors.

In a first example as illustrated in FIG. 6, the displacing member 205 of the head tank 35 includes detecting portions 205A and 205B having a different length from the support shaft 206 (i.e., a pivotal shaft) oriented downward. The first sensor 251 disposed at the carriage 33 detects the detecting portion 205A and the second sensor 301 disposed at a base member 101 of the apparatus side detects the detecting portion 205B.

In a second example as illustrated in FIG. 7, the displacing member 205 of the head tank 35 includes detecting portions 205A and 205B having a same length from the support shaft 206 (i.e., a pivotal shaft). The first sensor 251 of the carriage 33 detects the detecting portion 205A and the second sensor 301 of the apparatus side detects the detecting portion 205B.

Figure 8:
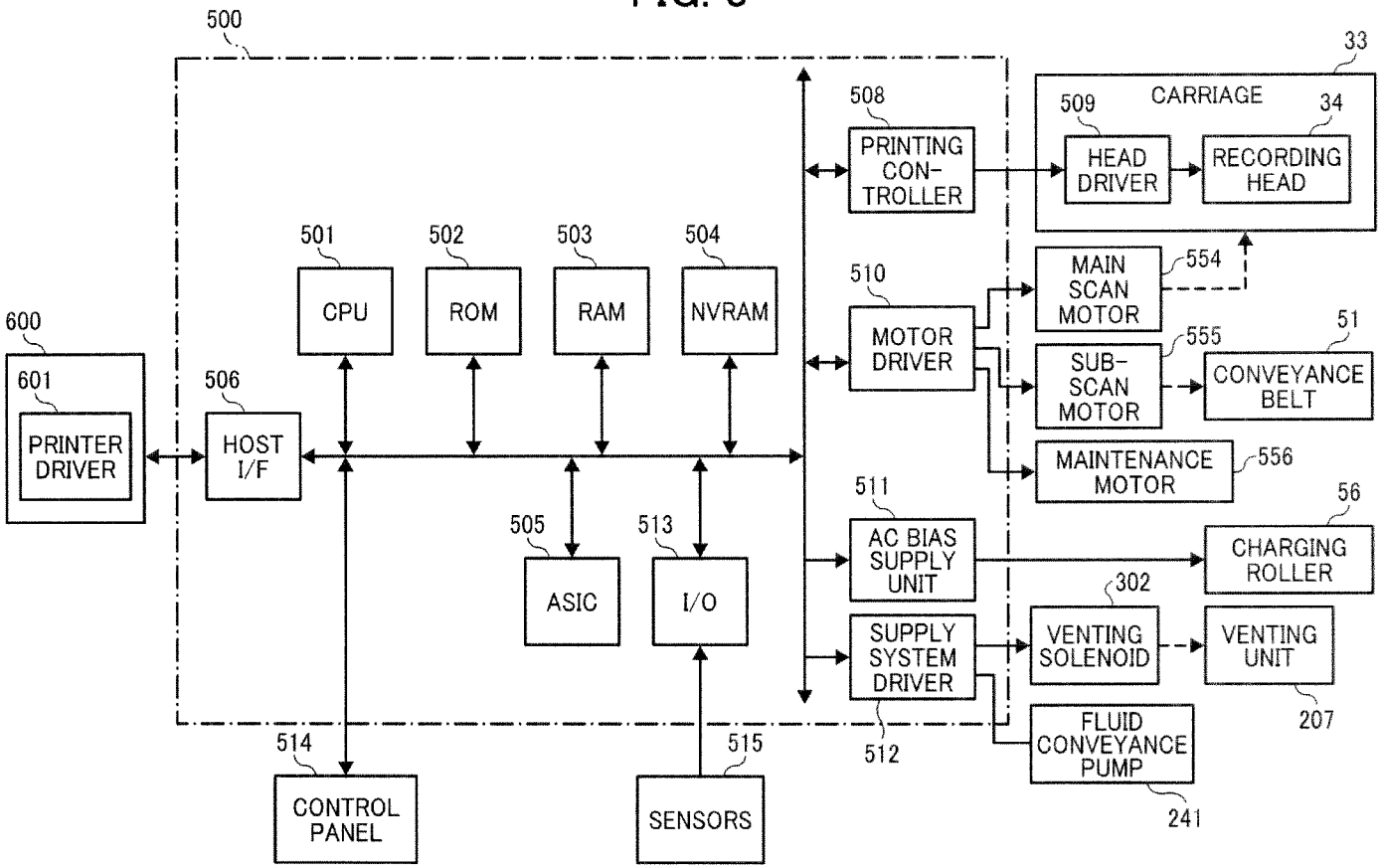
FIG. 8 is a block diagram illustrating a general outline of a controller.

Next, an outline of the controller in the image forming apparatus will now be described with reference to FIG. 8. FIG. 8 is an overall block diagram of the controller 500.

The controller 500 serves to control the apparatus entirely and includes a CPU 501 serving as a control means of various functions; various programs performed by the CPU 501; a read-only memory (ROM) 502 storing various fixed data; a random access memory (RAM) 503 temporarily storing image data; a rewritable nonvolatile memory 504 capable of holding data while the power to the apparatus is being shut down; and an application-specific integrated circuit (ASIC) 505 configured to handle various signals to the image data, image processing to perform rearrangement and the like, and input/output signals to control an entire apparatus.

The controller 500 further includes a data transmitter to drive and control the print head 34; a print controller 508 including a drive signal generator; a head driver or driver IC 509, disposed on the carriage 33, to drive the print head 34; a main scanning motor 554 to move the carriage 33 to scan; a sub-scanning motor 555 to move to circulate the conveyance belt 51; a motor driver 510 to drive a maintenance motor 556 of the maintenance mechanism 81; an AC bias power supply 511 to supply an AC bias to the charging roller 56; the venting solenoid 302, disposed on the apparatus body, to open/close the venting unit 207 of the head tank 35; and a supply system driver 512 to drive the fluid conveyance pump 241, and the like.

In addition, a control panel 514 for inputting necessary information to the apparatus and displaying the information thereon is connected to the controller 500.

The controller 500 further includes an I/F 506 through which data and signals are transmitted between a host and the apparatus. The I/F 506 receives data and signals via a cable or a network from the host 600 including an information processor such as a PC, an image reader such as an image scanner, a picture capturing device such as a digital camera, and the like.

The CPU 501 of the controller 500 reads and analyzes print data in a reception buffer included in the I/F 506, causes the ASICS 505 to perform necessary image processing and data rearrangement processing, and transfers the processed image data from the print controller 508 to the head driver 509. There is provided a printer driver 601 at a side of the host 600. The printer driver 601 generates dot pattern data for outputting an image.

The print controller 508 transmits the above image data as serial data as well as outputs transfer clock signals, latch signals, and control signals necessary to transfer the image data and ensure that the image transfer has been performed, to the head driver 509. The print controller 508 further includes a drive signal generator formed of a D/A converter to perform digital-to-analog conversion of pattern data of drive pulses stored in the ROM, voltage and current amplifiers, and the like, and outputs drive signals formed of a drive pulse or a plurality of drive pulses to the head driver 509.

The drive pulse is a drive signal transmitted from the print controller 508 based on the image data corresponding to one line of data serially input to the recording heads 34. The head driver 509 selectively applies the drive pulse to a drive element (for example, a piezoelectric element) that generates energy to cause the print head 34 to discharge the ink droplets, thereby driving the print head 34. In this operation, by selecting a drive pulse to formulate a drive signal, dots with various sizes such as a large dot, a medium dot, and a small dot can be selectively impacted.

An I/O 513 obtains information from various sensors 515 disposed in the image forming apparatus and extracts necessary information to control the entire printer including the print controller 508, the motor driver 510, the AC bias power supply 511, and an ink supply to the head tank 35.

The other sensors 515 include the first sensor 251 and the second sensor 301, the electrode pins 208*a* and 208*b*, an optical sensor to detect a position of the sheet, a thermistor to observe temperature and humidity inside the apparatus (such as an environmental temperature/humidity sensor), a sensor to observe voltage of the electrically charged belt, and an interlock switch to detect open/close of the cover. The I/O 513 performs controlling various sensors information.

Figure 9A:
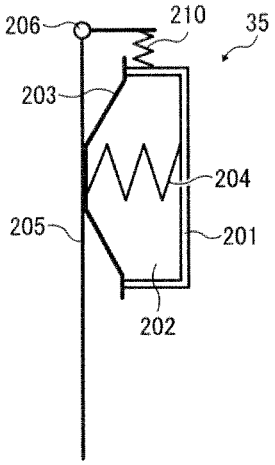
FIGS. 9A and 9B are schematic views of a displacing member of the head tank illustrating the displacement thereof.
Figure 9B:
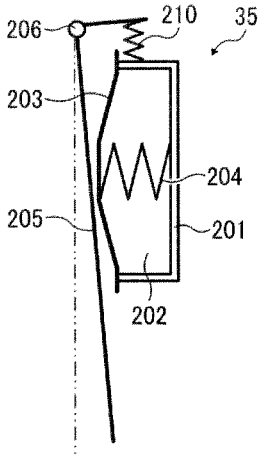
Figure 10:
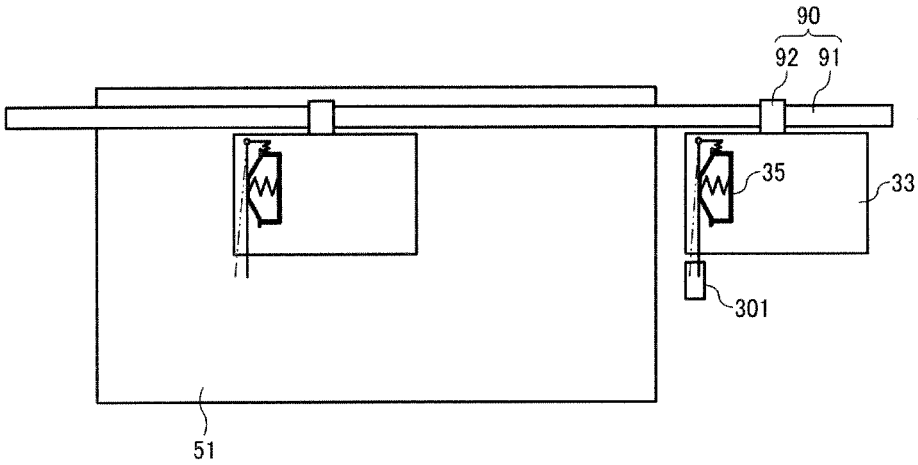
FIG. 10 is a schematic plan view of the head tank displacing member g position detection of the displacing member of the head tank.

Next, how to detect a position of the displacing member 205 of the head tank 35 will now be described with reference to FIGS. 9A and 9B and FIG. 10. FIGS. 9A and 9B are schematic views illustrating displacement of the displacing member of the head tank and FIG. 10 is a schematic plan view of the same illustrating how to detect the position thereof. In the following figures, the head tank 35 is shown in a simplified manner.

The displacing member 205 of the head tank 35 displaces in accordance with the remaining amount inside the head tank 35 between a position indicated by a solid line in FIG. 9A and a position indicated by a broken line in FIG. 9B.

As illustrated in FIG. 10, a position and displacement amount of the displacing member 205 can be detected as follows: a position of the carriage 33 when the displacing member 205 of the head tank 35 is detected by the second sensor 301 of the apparatus side is stored in the encoder 90, the carriage 33 is moved until the second sensor 301 again detects the displacing member 205 of the head tank 35 when the displacing member 205 of the head tank 35 has displaced; and the position of the carriage 33 is read by the encoder 90, so that the position and the displacement amount of the displacing member 205 are detected as a difference in the position of the carriage 33.

Because the remaining amount of ink inside the head tank 35 corresponding to the initial position of the displacing member 205 and the amount of ink corresponding to the displacement amount of the displacing member 205 are previously recognized, the remaining amount inside the head tank 35 can be obtained from the detected displacement amount of the displacing member 205.

Then, in order to control a supply amount of liquid to the head tank 35 by detecting the displacing member 205 of the head tank 35 using the second sensor 301, the printing operation is first stopped, the carriage 33 is moved up to the position where the second sensor 301 detects the displacing member 205, and the liquid supply operation is performed. On the other hand, when supplying ink to the head tank 35 during a printing operation, the liquid supply operation is performed without moving the carriage 33 up to the position where the second sensor 301 detects the displacing member 205.

Figure 11:
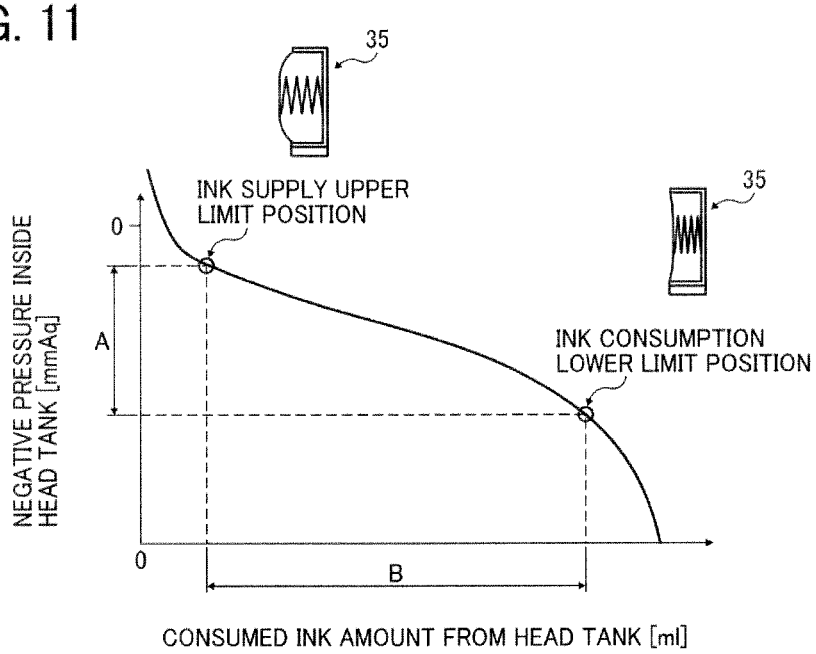
FIG. 11 is a view illustrating a relation between a negative pressure and an amount of ink in the head tank.

Next, a relation between the negative pressure and the ink amount inside the head tank 35 will now be described referring to FIG. 11. FIG. 11 is a view illustrating a relation between the negative pressure and the ink amount inside the head tank.

As explained heretofore, in a state in which the ink is filled in the head tank 35, the ink inside the head tank 35 is sucked by a nozzle and discharged or the liquid conveying pump 241 reversely sends the ink to the main tank 10. As a result, the film 203 is pulled inwardly to the main tank 10 against the resilient force of the spring 204 and the spring 24 is compressed to thus cause the negative pressure inside the head tank 35 to be increased. When the ink is supplied into the head tank 35 from this state, because the film 203 is pushed outward the head tank 35, the spring 204 extends and the negative pressure decreases.

When the negative pressure inside the head tank 35 is too small, the ink leaks from the recording head 34. By contrast, when the negative pressure is too high, air and dust tends to mix in from the nozzle, to cause defective discharge to occur. The negative force in the head tank 35 needs to be kept within a constant range in order to keep an optimized meniscus shape for appropriate liquid discharge.

Specifically, as illustrated in FIG. 11, because the negative pressure inside the head tank 35 is inversely proportional to he ink amount inside the head tank 35, when the ink amount inside the head tank 35 is large, the negative pressure inside the head tank 35 becomes small, and when the ink amount is small, the negative pressure inside the head tank 35 becomes high.

Then, the ink supply to the head tank 35 is controlled such that the ink amount ejected from the head tank 35 is within a consumed ink amount B in which the negative pressure inside the head tank 35 falls within a predetermined negative pressure control range A.

The consumed ink amount of the head tank 35 corresponding to a minimum value (with low negative pressure and small consumed ink amount) of the negative pressure control range A is an "ink supply upper limit position" with respect to the displacement position of the displacing member 205 (that is, an "ink supply upper limit amount" with respect to the ink amount). The consumed ink amount of the head tank 35 corresponding to a maximum value (with high negative pressure and large consumed ink amount) of the same range A is an "ink consumption lower limit position" with respect to the displacement position of the displacing member 205 (that is, an "ink consumption lower limit amount" with respect to the ink amount). FIG. 10 additionally shows a state of the head tank 35 in each position.

Figure 12:
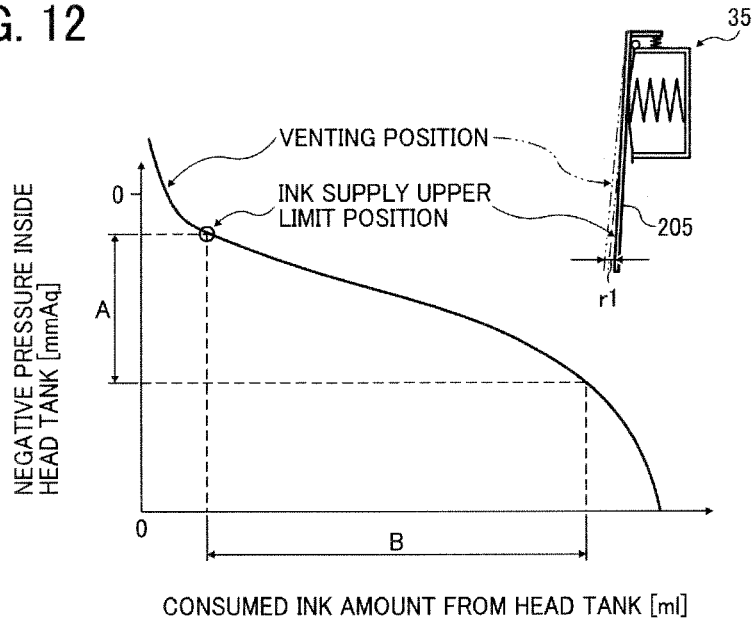
FIG. 12 is a view illustrating an ink supply upper limit position of the head tank.

Next, how to set an ink supply upper limit position of the head tank 35 will be described with reference to FIG. 12. FIG. 12 is a view of the set position.

In the present embodiment, the head tank 35 includes a venting unit or valve 207. When the venting unit 207 is open, air flows in the head tank 35 so that the film 203 extends maximally and the displacing member 205 also displaces. The thus displaced position is a venting position and is a reference position of the displacing member 205. In the present embodiment, the ink supply upper limit position is set at a position at which the displacing member 205 displaces by a predetermined displacement amount r1 from the venting position in a direction in which the ink remaining amount is reduced.

As described above, the venting position and the ink supply upper limit position are detected and stored such that the position of the displacing member 205 is detected by the second sensor 301 and the detected position is set as a position of carriage 33 which is detected by the encoder 90 and is stored.

Figure 13:
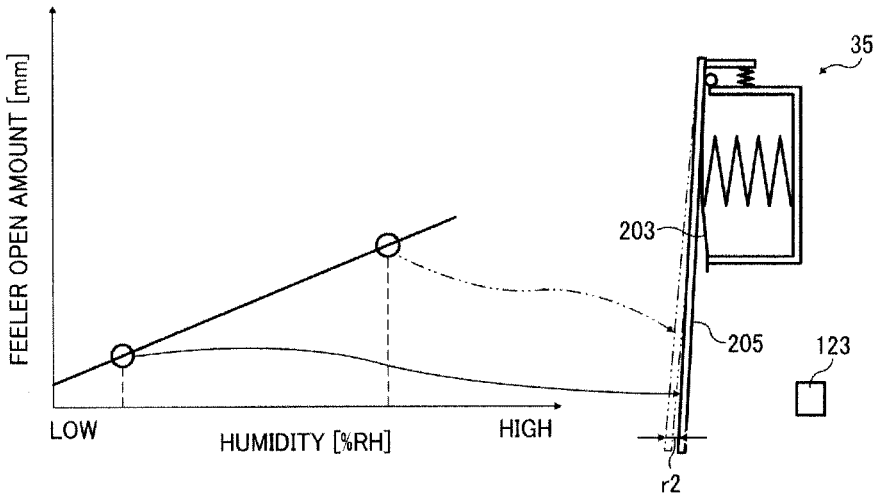
FIG. 13 is a view illustrating a relation between a displacement amount of the displacing member and environmental conditions of the image forming apparatus.

Next, a relation between environmental conditions of the image forming apparatus and the displacement amount of the displacing member 205 will now be described with reference to FIG. 13. FIG. 13 is a schematic view illustrating the same relation as described above. In FIG. 13, the displacing member 205 is configured as a feeler.

Changes in the environmental conditions may include changes in humidity, temperature, and atmospheric pressure. For example, when the film 203 extends due to the change in the humidity, when the head tank 35 is open by the venting unit 207, the pressure inside the head tank 35 becomes the same as that of the atmospheric pressure. The displacing member 205 displaces due to this change, and the displaced position is different according to the humidity condition.

For example, as illustrated in FIG. 13, because the film 203 extends when the humidity is high, the displacing member 205 is separated from the head tank 35 more than when the humidity is low, that is, the displacing member 205 moves in the direction when the remaining liquid in the head tank is increasing. By contrast, because the film 203 shrinks when the humidity is low, the displacing member 205 approaches the head tank 35, that is, the displacing member 205 moves in the direction when the remaining liquid in the head tank is reducing. The displacement amount in this case is defined to be r2.

As described above, because the reference position of the displacing member 205 is set as the venting position, the ink supply upper limit position also changes in accordance with the change of the venting position.

Accordingly, an environment detection sensor 123 capable of detecting changes in the environmental condition is provided. When the film 203 extends or shrinks due to the environmental change and the environment detection sensor 123 detects such an environmental change that the pressure inside the head tank 35 and the position of the displacing member 205 change, the venting unit 207 is opened again and the venting position or the reference position and the ink supply upper limit position are again measured and stored.

With this configuration, the negative pressure of the head tank 35 and the ink amount can be correctly controlled so as to match with the environmental condition of the place where the apparatus is installed.

Figure 14A:
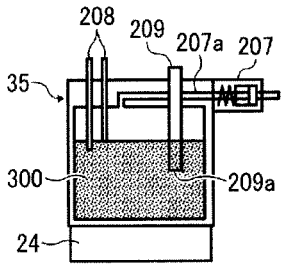
FIGS. 14A to 14C are views illustrating how to set the ink amount in the head tank at a full tank position when the tank is vented.
Figure 14B:
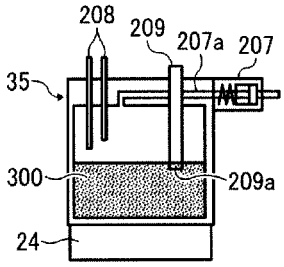
Figure 14C:
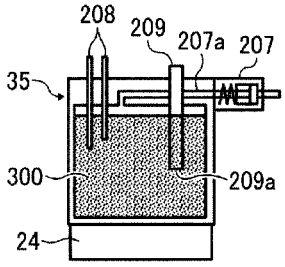

Next, how to set the ink amount inside the head tank 35 to a full tank position at the venting time will now be described referring to FIGS. 14A to 14C. FIGS. 14A to 14C are views illustrating how to set the ink amount inside the head tank to the full tank position.

As described above, the head tank 35 includes electrode pins 208 to detect a liquid level, a venting path 207*a* to allow an interior of the head tank 35 to communicate with the atmosphere, and the venting unit 207 to open or close the venting path 207*a*.

As an example to set the head tank 35 at the full tank position, from a state as illustrated in FIG. 14A, by releasing the negative pressure inside the head tank 35 by opening the venting unit 207, a liquid level in the head tank 35 lowers as illustrated in FIG. 14B.

It is preferred that a supply opening 209*a* of the supply port 209 be below the liquid level. This is because when the supply opening 209*a* is above the liquid level, air mixes in the supply tube 36 via the supply opening 209*a* or the supply port 209. When the ink is supplied subsequently, air bubbles may be discharged with ink from the supply opening 209*a*. When the supply of ink continues in this state, the air bubbles attach to the interior of the venting unit 207, thereby causing agglomeration of the valve and leak of the liquid to occur.

After the negative pressure in the head tank 35 is released and the liquid level lowers, the ink 300 is supplied as illustrated in FIG, 14C. When the ink 300 is supplied, the liquid level is elevated, and the ink 300 continues to be supplied until the electrode pins 208*a* and 208*b* detect the liquid level of a predetermined height.

Then, when the venting unit 207 is closed and a predetermined amount of ink is discharged from the nozzle or sent to the main tank 10 in reverse, the pressure inside the head tank 35 becomes a predetermined value and the ink amount of the head tank 35 can be a value that can obtain a predetermined value of negative pressure.

Figure 15:
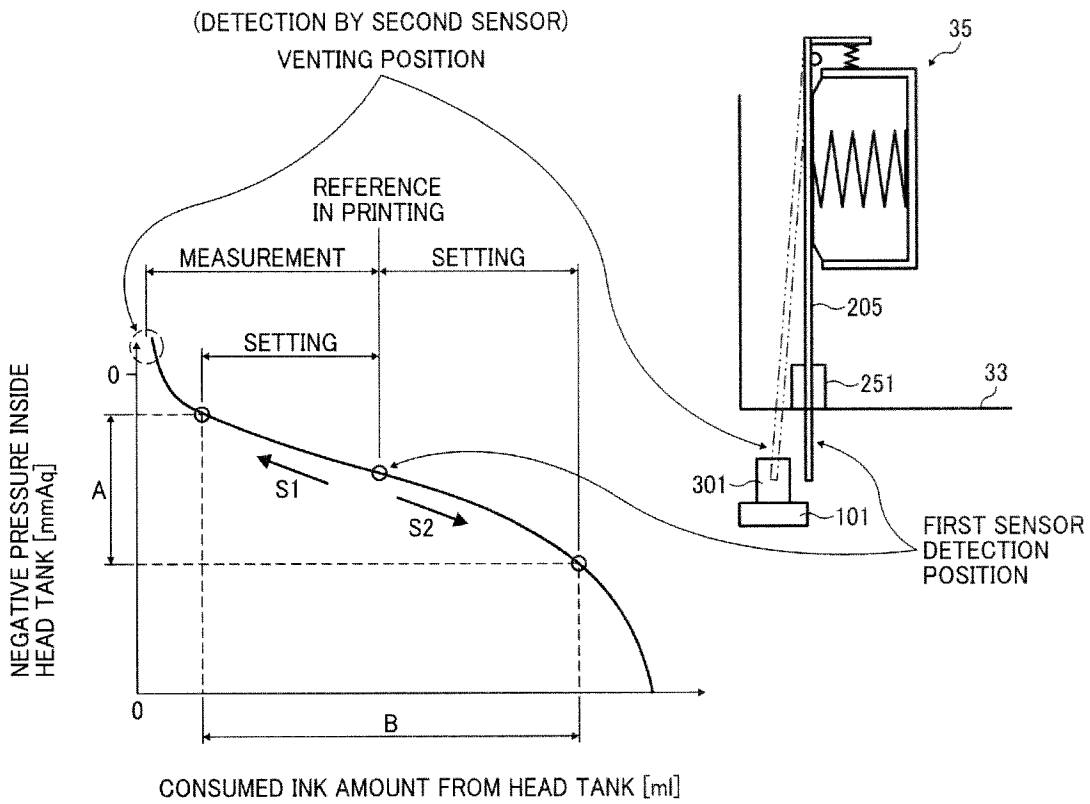
FIG. 15 is a view illustrating an outline of an ink supply control according to a first embodiment of the present invention.

Next, a general outline of ink supply control in a first embodiment of the present invention will now be described with reference to FIG. 15. FIG. 15 is an view illustrating how to supply ink according to the first embodiment.

In the present first embodiment, the first sensor 251 disposed on the carriage 33 detects a position of the displacing member 205 which is defined as a first position, and the second sensor 301 disposed on a base 101 of the apparatus body detects the venting detection position which is defined as a second position. A feeler displacement amount being the difference between the first position and the second position is obtained. During the printing, the ink supply upper limit position (or the maximum value) and the ink consumption lower limit position (or the minimum value) set based on the detection position by the first sensor 251 are controlled so that the printing ink supply control is performed.

Thus, when the ink supply control during the printing is performed, the reference position is transferred from the venting position being the original reference position to the detection position by the first sensor 251 on the carriage, the ink supply upper limit position and the ink consumption lower limit position am obtained based on the detection position by the first sensor 251, and ink consumption and ink supply are repeated within the set ink supply upper limit position and the ink consumption lower limit position so that the ink remaining amount inside the head tank 35 is kept constant.

Because various variations exist for each device such as a mounting position of the first sensor 251 on the carriage 33, dimensions of the parts in the head tank 35, and extension and contraction of the film 203 due to the humidity, an ink supply control suitable for each apparatus should be performed. For this reason, various control parameters are set preliminarily in the present embodiment, as described with reference to FIGS. 16 to 20.

In the ink supply control during printing, because the detection position (the first position) by the first sensor 251 on the side of the carriage to detect the displacing member 205 is defined as a reference position, a displacement distance L [mm] from the venting position being the original reference to the detection position by the carriage side first sensor 251 is measured.

Figure 16C:
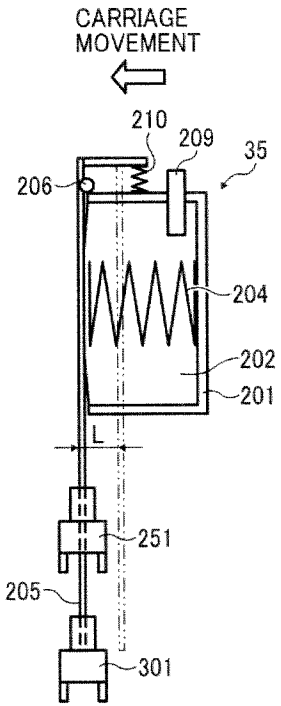
FIGS. 16A to 16C are views illustrating how to measure a displacement distance Las a preliminary setting for setting a control parameter value according to the first embodiment.
Figure 16B:
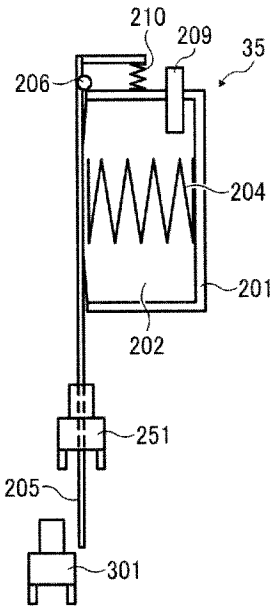
Figure 16A:
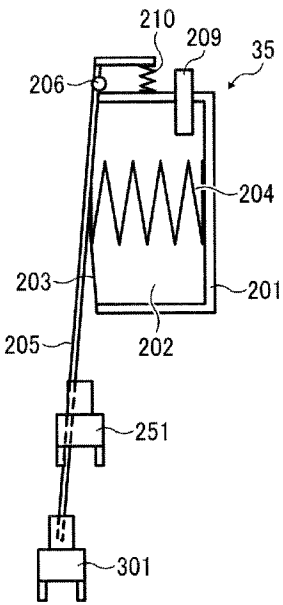

Specifically, as illustrated in FIG. 16A, the carriage 33 is moved to a position at which the apparatus side second sensor 301 can detect the displacing member 205. Then, as illustrated in FIG. 16B, the fluid conveyance pump 241 is driven in reverse from a state in which the displacing member 205 is positioned at the venting position so that the ink is sent in reverse from the head tank 35 to the main tank 10 until the carriage side first sensor 251 detects the displacing member 205, and the reverse operation of the fluid conveyance pump 241 is stopped.

Thereafter, as illustrated in FIG. 16C, in a state in which the carriage side first sensor 251 detects the displacing member 205, the carriage 33 is moved up to a position where the apparatus side second sensor 301 can detect the displacing member 205. By measuring the distance that the carriage is moved by the linear encoder 90, the displacement distance (or the displacement difference amount) L [mm] of the displacing member 205 from the venting position up to the position in which the first sensor 251 detects the displacing member 205 is measured.

Figure 17:
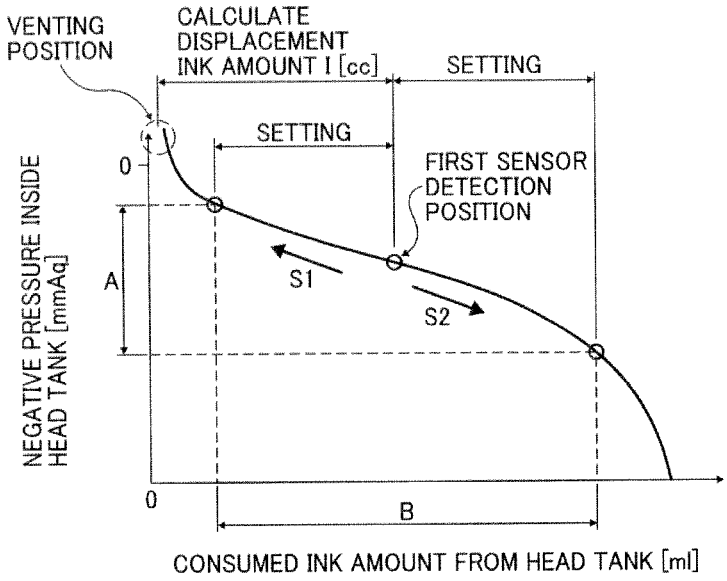
FIG. 17 is a view illustrating how to calculate a displacement ink amount I.

Then, based on the measured displacement distance L [mm], as illustrated in FIG. 17, a displacement ink amount I [cc] per displacement distance L [mm] is calculated using an ink amount conversion coefficient Rmax [cc/mm] for the displacement distance L [mm] that takes into account the proportional relation between the consumed ink amount from the head tank 35 and the displacement amount of the displacing member 205. Arrow S1 in FIG. 17 shows an ink supply direction and an arrow S2 in FIG. 17 shows an ink consumption direction, which is applied to following figures.

FIG. 17 shows a negative pressure of the displacement ink amount I [cc], and areas of the consumed ink amount from the head tank 35 and the displacement ink amount I [cc]. The displacement ink amount I can be calculated based on a following formula (1):

Formula (1)

$$I[\text{cc}]=L[\text{mm}]\times\text{Rmax}[\text{cc/mm}] \quad (1)$$

wherein the ink amount conversion coefficient Rmax [cc/min] is a value obtained so that the consumed ink amount for the displacement amount of the displacing member 205 becomes a maximum value.

Next, as a preliminary setting 2, an ink amount W [cc] from the detection of the displacing member 205 by the first sensor 251 to the ink consumption lower limit position is set.

Specifically, because the ink inside the head tank 35 is consumed by printing, the displacing member 205 displaces in a direction in which the ink remaining amount is decreasing. In this case, from a state in which the carriage side first sensor 251 detects the displacing member 205, the ink amount W [cc] until the ink consumption lower limit position is detected is set when the liquid droplet amount discharged from the nozzle of the recording head 34 is counted by "soft count". In the soft count, the number of droplets for each droplet of the discharged liquid droplet is counted so that a total of the droplet amount for each droplet size obtained by multiplying the droplet amount by the number of droplets is calculated and the liquid consumption amount is obtained.

Figure 18:
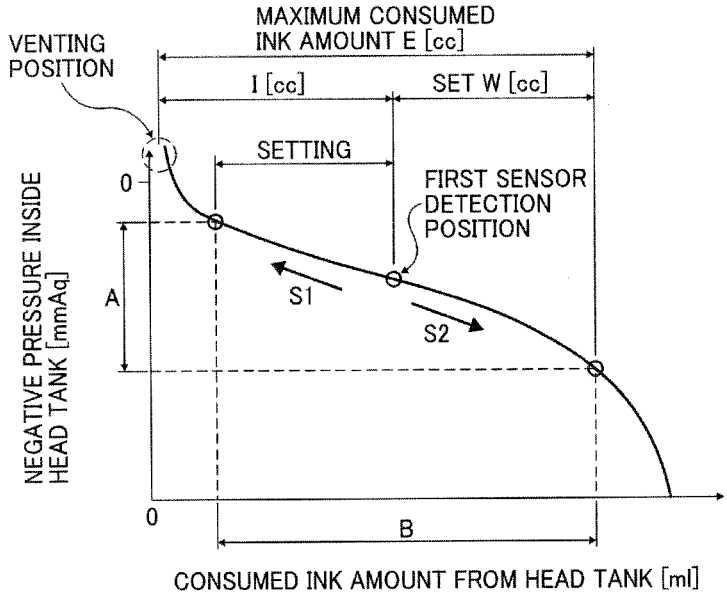
FIG. 18 is a view illustrating how to set an ink amount W.

FIG. 18 is a view illustrating the preliminary setting 2. The ink amount W [cc] is set such that the displacement ink amount I [cc] obtained in the preliminary setting 1 is subtracted from a maximum consumed ink amount E [cc] when the ink amount between the venting position and the ink consumption lower limit position is assumed to be the maximum consumed ink amount E [cc].

The ink amount W [cc] is set as a soft count amount not less than the ink consumption lower limit position (or value) under various conditions including variations of the mounting position of the carriage side first sensor 251, sensor detection errors, maximum errors such as fluctuations of the displacing member 205 in the printing operation, and the maximum deviation (100+Smax)[%] of the soft count value. The ink amount W [cc] can be calculated based on a following formula (2):

Formula (2)

$$W[\text{cc}]=(E[\text{cc}]-I[\text{cc}]-\Delta 2[\text{mm}](\text{various variations})\times \text{Rmax}[\text{cc/mm}])/\{(100+\text{Smax})[\%]/100\} \quad (2)$$

Figure 19:
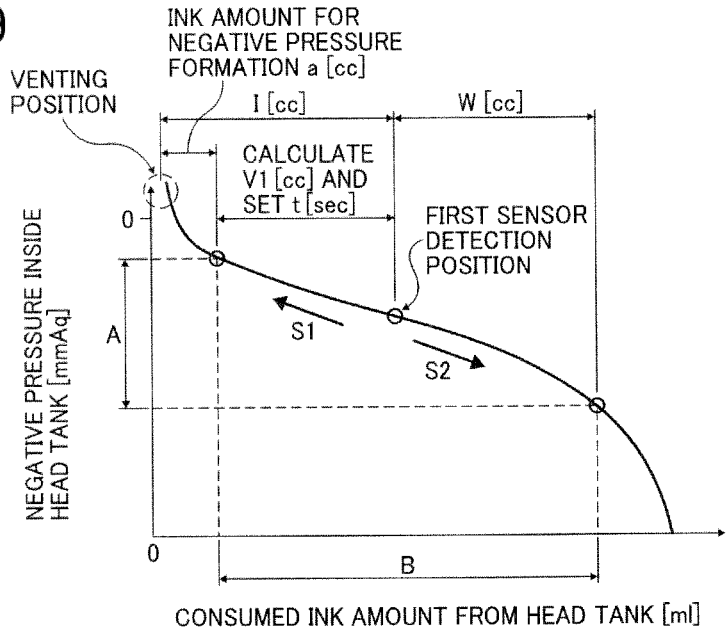
FIG. 19 is a view illustrating how to set a driving time t.

FIG. 19 is a view illustrating a preliminary setting 3. Herein, after the ink consumption lower limit is detected by the soft count in the printing operation, the fluid conveyance pump 241 is driven so that the ink is supplied from the main tank 10 to the head tank 35. In this case, a driving time t [sec] of the fluid conveyance pump 241 is set from when the carriage side first sensor 251 detects the displacing member 205.

By subtracting an ink amount a [cc] for forming the negative pressure to render the ink supply upper limit amount obtained from the venting position and various variations amount such as sensor detection errors of the carriage side first sensor 251 and the apparatus side second sensor 301 from the ink amount I [cc] obtained previously in the preliminary setting 1, the ink amount VI [cc] can be obtained.

Then, the driving time t [sec] of the fluid conveyance pump 241 after the carriage side first sensor 251 has detected the displacing member 205 corresponds to the time during when the ink amount VI is supplied by the fluid conveyance pump 241 at its maximum ink supply flow amount Qmax [cc/sec].

In addition, the driving time t [sec] is so set as not to exceed the ink supply upper limit amount taking into account effects of variations such as conveying liquid amount of the fluid conveyance pump 241, software control delays, detection error of the carriage side first sensor 251. fluctuations of the displacing member 205, and the like.

The ink amount VI [cc] and the driving time t [sec] can be calculated based on following formulae (3) and (4):

[Formula 3]

$$V1[\text{cc}]=I[\text{cc}]-a[\text{cc}]-(\Delta 1[\text{mm}](\text{each variation amount})\times \text{Rmin}[\text{cc/mm}] \quad (3)$$

[Formula 4]

$$t[\text{sec}]=V1[\text{cc}]/\text{Qmax}[\text{cc/sec}] \quad (4)$$

Alternatively, the ink amount a [cc] for the negative pressure formation can be set as an ink amount necessary for forming the negative force converted from a predetermined distance A [mm] from the venting position. Specifically, it is possible to set the second position at a position obtained by subtracting the predetermined distance A [mm] from the venting position.

Figure 20:
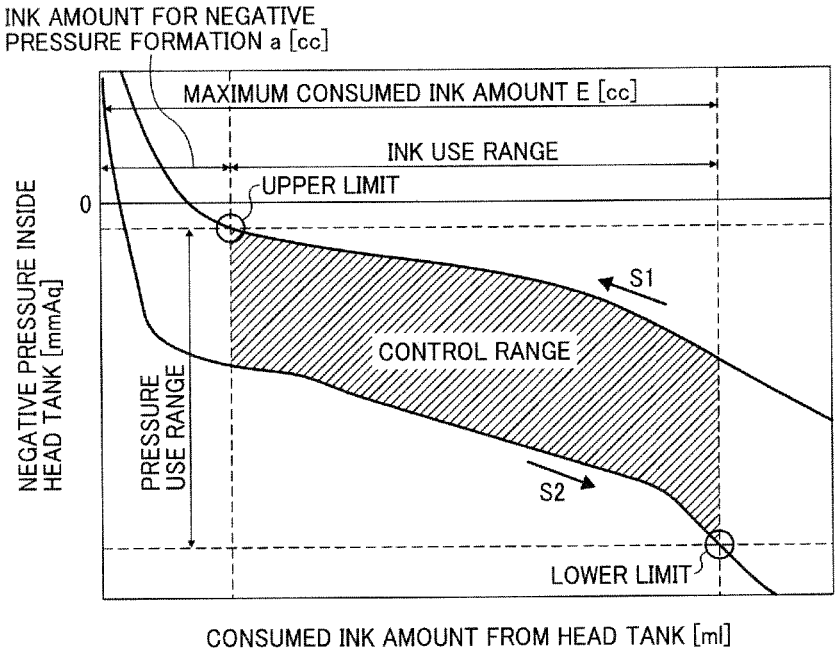
FIG. 20 shows an actual control range in the first embodiment.

These preliminary settings are made taking into account mechanical variations of each part, variations in optical detection, control errors, and property of the negative pressure of the head tank 35. Because the head tank 35 includes negative pressure characteristics having a hysteresis due to environmental conditions such as temperature and humidity and ink discharge and supply to and from the head tank 35 as illustrated in FIG. 20, the ink amount inside the head tank 35 needs to be constantly controlled within the control range considering the above characteristics.

Figure 21:
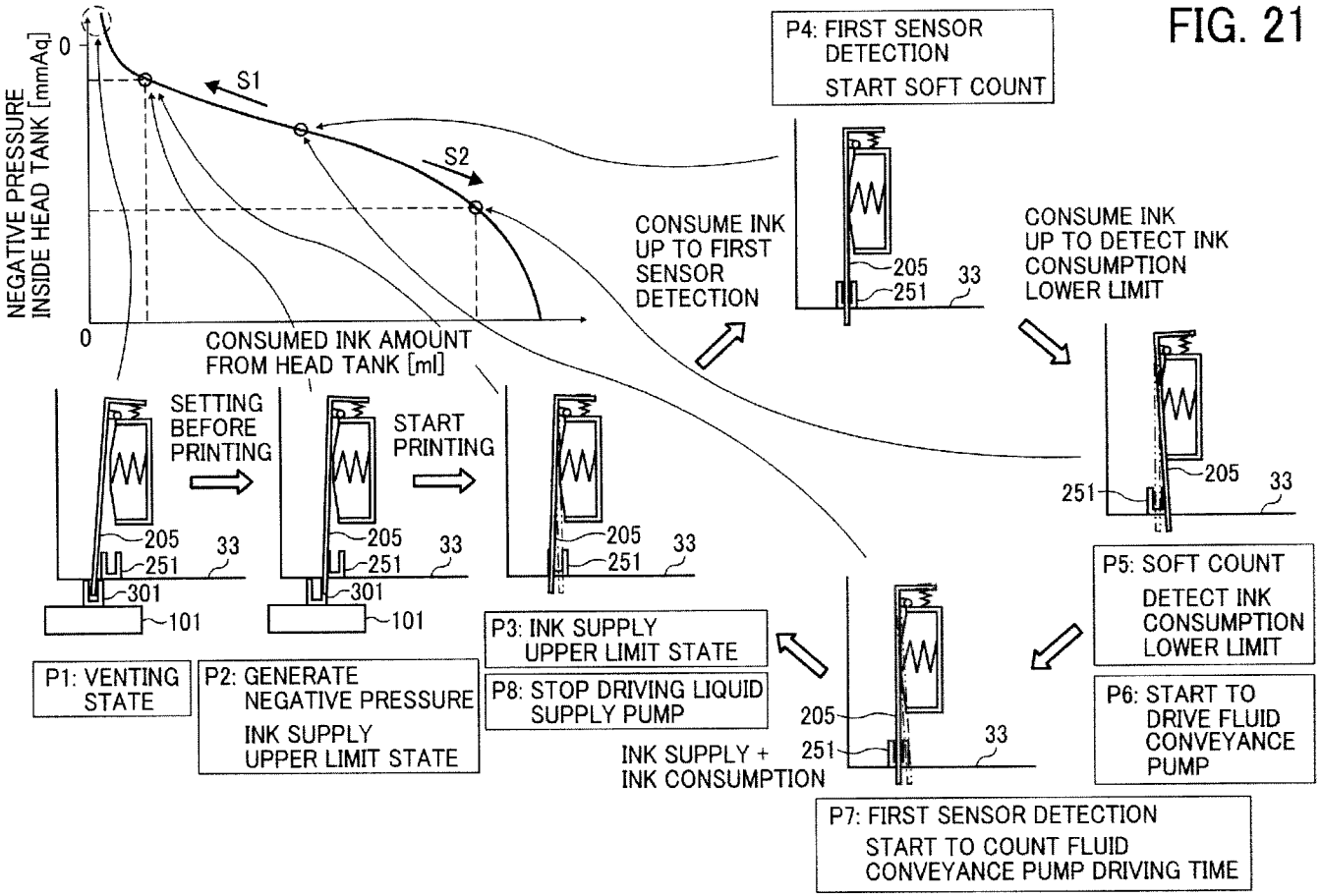
FIG. 21 is a view illustrating a state transition from a venting state of the head tank in the printing operation to a liquid supply pump driving termination.
Figure 22:
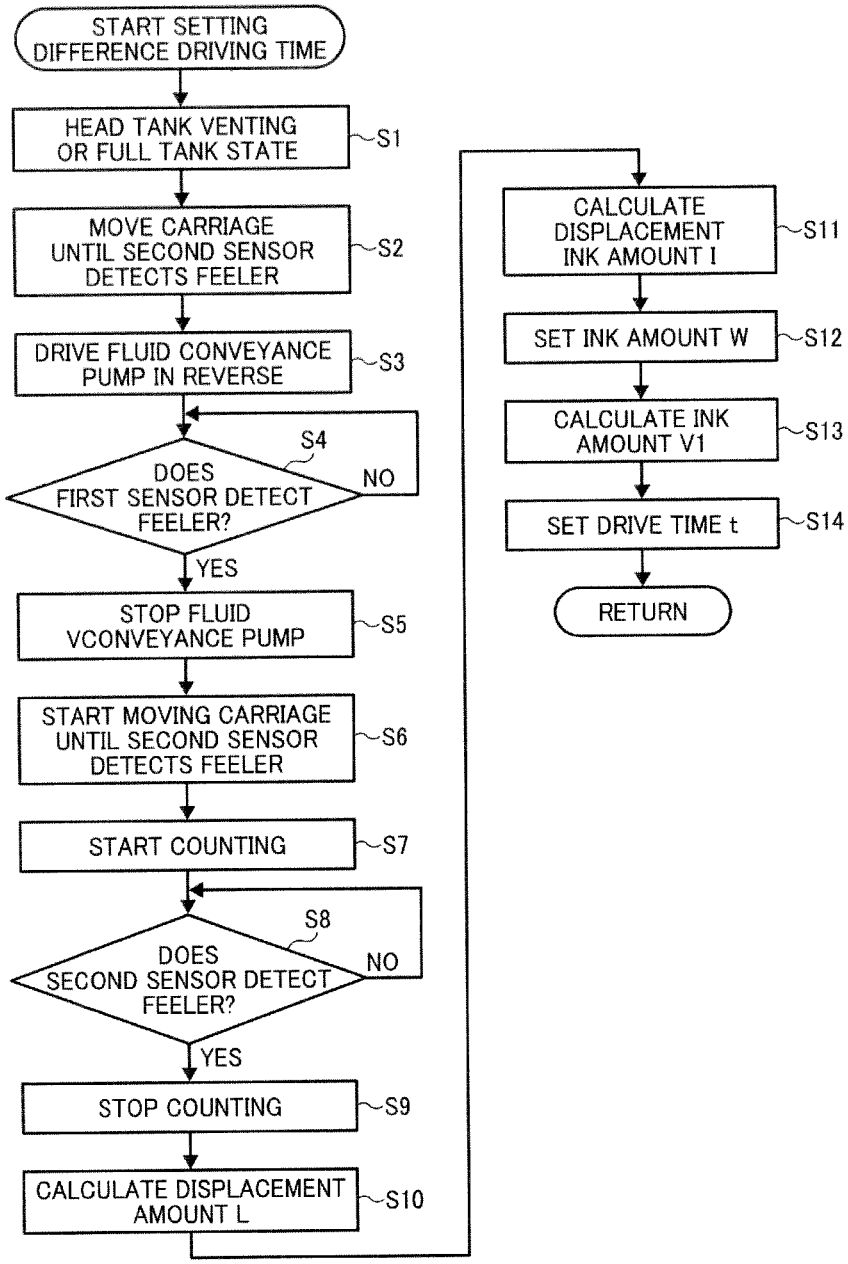
FIG. 22 is a flowchart illustrating a preliminary setting performed by a controller.

Next, ink consumption during the printing operation and a basic ink supply control operation will now be described with reference to FIG. 21. FIG. 21 is a view illustrating a state transition from a venting state of the head tank in the printing operation to a liquid supply pump driving termination.

In states P1 and P2, the preliminary settings including measurements and control value setting are performed for ink supply control during printing and a process is held in a state of ink supply upper limit.

When the printing is performed, the displacing member 205 displaces along with ink consumption from a state P3. If the ink is consumed until the carriage side first sensor 251 detects the displacing member 205 in a state P4, the soft count of the consumed ink amount is started.

Thereafter, when it is detected that the ink amount W [cc] is consumed up to the ink consumption lower limit, the state transits to a state P5 and the fluid conveyance pump 241 is started to be driven in a state P6 and the ink is supplied from the main tank 10 to the head tank 35.

Because the ink is supplied to the head tank 35, the displacing member 205 of the head tank 35 again displaces to the detection position of the carriage side first sensor 251 in state P7, Further, because the fluid conveyance pump 241 is driven by the driving time t [sec] additionally and the ink supply continues, the state becomes a state P8 and returns to the initial state P3 at the time of the start of printing.

The reason why such a series of ink consumption and ink supply control operation is enabled is that when the carriage side first sensor 251 detects the displacing member 205, cumulative detection errors such as the soft count error and the ink supply amount error of the fluid conveyance pump 241 can be eliminated.

In addition, control that takes into account various variations due to precision of each part of the device and environmental conditions is enabled by using two sensors, on the carriage side first sensor 251 and the apparatus side second sensor 301.

Next, a driving control of the fluid conveyance pump according to the present embodiment will now be described.

In the present embodiment, when the fluid conveyance pump 241 is driven to supply ink from the main tank 10 to the head tank 35, cumulative driving time of the fluid conveyance pump 241 is measured. When the cumulative driving time exceeds a previously-set predetermined time (which is called a "timeout threshold"), the fluid conveyance pump 241 is stopped.

Here, the cumulative driving time of the fluid conveyance pump 241 during the printing operation is counted from when the ink consumption up to the ink amount W [cc] being the ink consumption lower limit in the state P5 of FIG. 21 is detected and the driving of the fluid conveyance pump 241 is started until the carriage side first sensor 251 detects the displacing member 205.

Although the fluid conveyance pump 241 is driven to convey the ink, there occurs a case in which the ink supply is not performed normally. For example, when the ink remaining amount in the main tank 10 is too small or the main tank 10 becomes empty, the normal ink supply operation cannot be performed. In addition, if the fluid conveyance pump 241 is damaged, it may occur that the ink supply cannot be done or the ink supply flow amount is smaller than a predetermined flow amount which is expected when the driving time t has been set. Further, when the ink or air is leaked from the ink supply path such as the supply tube 36 or from the head tank 35, the ink supply cannot be done properly. There is another reason that the displacing member 205 is damaged or the carriage side first sensor 251 is out of function.

Then, if the fluid conveyance pump 241 is driven, when the carriage side first sensor 251 does not detect properly the displacing member 205 for a predetermined period of time, the driving of the fluid conveyance pump 241 is stopped. In this case, that the apparatus is not in a normal state can he reported.

In addition, when supplying ink using the second sensor 301 from the main tank 10 to the head tank 35, if the apparatus includes a function to determine the near-end or end of the main tank 10 even though the displacing member 205 does not displace during a predetermined period of time, such a control is treated as a fail-safe function in the present invention.

In the present embodiment, at a time of printing end, when the soft count of the ink consumption amount is started after the carriage side first sensor 251 has detected the displacing member 205 between the states P4 and P5 in FIG. 21, the fluid conveyance pump 241 is driven to supply ink similarly, and when the cumulative driving time of the fluid conveyance pump 241 exceeds the previously-set predetermined timeout threshold, the fluid conveyance pump 241 is stopped.

In the present embodiment, the previously-set timeout threshold is preferably the shortest time possible.

This is because, when the displacing member 205 is not detected by the carriage side first sensor 251 even though the fluid conveyance pump 241 is driven, a damage to the apparatus itself or a great amount of ink leakage may occur due to, for example, leakage of the ink or air from the ink supply path such as a supply tube 36 or from the head tank 35, damage of the displacing member 205, and breakdown of the carriage side first sensor 251, and the like. Accordingly, detection or notification of the failure should be as early as possible.

Further, the continuous driving of the fluid conveyance pump 241 even after the ink amount inside the main tank 10 becomes too small or empty creates a very high negative pressure in the ink supply path from the main tank 10 to the fluid conveyance pump 241 and causes a great amount of air to be mixed into the ink supply path. If a great amount of air mixes into the ink supply path, the mixed air may be discharged with ink from the supply opening 209*a* into the head tank 35.

In such a state, if the ink is supplied to the head tank 35 as in the venting state, when the ink supply is continued, air bubbles pass through the venting path 207*a* and attach the valve 207*b* of the venting unit 207 before the electrode pins 208 detect the ink liquid level, thereby causing agglomeration of the ink around the valve or the ink leakage.

Further, if a great amount of air mixes in the head tank 35, the air expands or contracts due to temperature change and the pressure inside the head tank greatly changes, thereby causing such a damage of ink leakage or inability to detect the ink liquid level by the electrode pins 208. Thus, when the great amount of mixed air is detected, the ink supply control is performed uselessly in the venting condition.

Then, in the present embodiment, the cumulative driving time of the fluid conveyance pump 241 is measured until the carriage side first sensor 251 detects the displacing member 205 not until the ink amount inside the head tank 35 reaches the ink supply upper limit amount, and the timeout threshold is set taking into account the time to supply a low amount of ink.

With this setting, the previously set timeout threshold may be the shortest time possible.

Setting of the timeout threshold as above is in particular effective to the ink supply operation during printing in which the ink inside the head tank 35 is being consumed by driving the fluid conveyance pump 241, performing the ink supply, and discharging the liquid droplet from the recording head 34 by the printing operation.

How to set the predetermined timeout threshold will now be described.

The predetermined timeout threshold tout [sec] is calculated based on an ink amount inside the head tank 35 when the fluid conveyance pump 241 is driven, an ink supply amount C [cc] until the carriage side first sensor 251 detects the displacing member 205, and an ink supply amount Q [ml/sec] of the fluid conveyance pump 241.

Among timeout thresholds tout [sec], a first timeout threshold tout1 [sec] for supplying ink to the head tank 35 while consuming the ink of the head tank 35 in the printing operation in which liquid droplets are discharged from the recording head 34 can be calculated from the ink supply amount C [cc], a predetermined minimum ink supply amount Qmin [ml/sec] of the fluid conveyance pump 241, and a maximum ink discharge amount dmax [cc/sec] according to the formula (4).

By contrast, a second timeout threshold tout2 [sec] for supplying ink to the head tank 35 without consuming the ink of the head tank 35 in the non-printing time can be calculated from the predetermined minimum ink supply amount Qmin [ml/sec] of the fluid conveyance pump 241 according to the formula (5).

In obtaining the timeout thresholds tout1 and tout2, as following formulae represent, a correction value a is added, which is a value that takes into account the sensor detection error by the carriage side first sensor 251 and the fluctuations of the displacing member 205 in the case of supplying ink during the printing operation.

[Formula 5]

$$\text{tout1[sec]}=C\text{[cc]}/(\text{Qmin [cc/sec]}-\text{dmax[cc/sec]})+\alpha\text{ [sec]} \quad (5)$$

[Formula 6]

$$\text{tout2[sec]}=C\text{[cc]}/\text{Qmin[cc/sec]}+\alpha\text{[sec]} \quad (6)$$

Another example for setting the timeout threshold tout [sec] will now be described.

First, various printing modes are available such as a high-speed mode in which priority is given to the print speed rather than the image quality and a high resolution mode in which image quality is prioritized than the print speed. In the high-speed mode, because an image is formed by a low number of times of carriage scanning compared to the high-resolution mode, the size of the ink droplet discharged from the head becomes large and the ink amount discharged in one scanning becomes relatively much.

Then, the discharged droplet amount from the head or the control on the discharge speed varies depending on the printing mode when performing the printing operation, and when the maximum ink discharge amount dmax [cc/sec] is different, the first timeout threshold tout1 [sec] can also be changed depending on each printing mode.

When the ink supply to the head tank 35 during the printing operation is set to be performed at a non-printing area other than the printing area to which the printing to the recorded medium is performed, the first timeout threshold tout1 [sec] is to be calculated taking into account a stay time of the recording head at the non-printing area and the stay time of the recording head at the printing area. The stay time means the period of time in which the recording head stays opposite the printing area or the non-printing area.

In this case, the stay time of the recording head in the printing area is different based on the size of the recorded medium. Then, the first timeout threshold tout1 [sec] is set based on the size of the recorded medium. Specifically, it is preferable that the first timeout threshold tout I [sec] be changed based on the size of the recorded medium.

On the other hand, the stay time of the recording head in the non-printing area means, for example, acceleration and deceleration driving time of the carriage 33 or the conveyance time in which the recorded medium is conveyed, When the conveyance amount to convey the recorded medium is different based on the printing mode such as the high-speed mode or the high-resolution mode, the first timeout threshold tout I [sec] can be set depending on each printing mode.

Further, when as a printing operation, two-way print mode in which printing is performed both in the reciprocal back and force movement of the carriage 33 or one-way print mode in which printing is performed either movement of the carriage 33 can be selected, the first timeout threshold tout1 [sec] can be made different depending on each printing operation, The above preliminary setting according to the controller will be explained according to a flowchart in FIG, 22.

First, the head tank 35 is brought into the venting state (in step S1) and the carriage 33 is moved to a position in which the second sensor 301 detects the displacing member 205, which is the second position (S2).

Then, by driving the fluid conveyance pump 241 in reverse (S3) to absorb ink until the first sensor 251 detects the displacing member 205 (S4), the reverse operation of the fluid conveyance pump 241 is stopped (S5).

Subsequently, the carriage 33 is started to move to a position at which the second sensor 301 detects the displacing member 205 (S6) and the linear encoder 90 is started to count (S7) and is stopped counting (S9) upon the second sensor 301 has detected the displacing member 205 (S8).

With this operation, the displacement amount or distance L of the displacing member 205 between the venting position or the second position and the first position at which the first sensor 251 detects the displacing member 205 is calculated (S10).

As described heretofore, the displacement ink amount I is calculated based on the displacement amount L and the like (S11), the ink amount W is set (S12) and the ink amount VI is calculated (S13), and the driving time t of the fluid conveyance pump 241 corresponding to the difference when the ink supply is performed without using the second sensor 301 is set (S14).

The venting position is set as the second position here, but as described above, the full tank position can be set as the second position, and the supply amount corresponding to the displacement amount between the second position and the first position can be stored as the difference. This difference depends on how the full tank position is defined.

Figure 23:
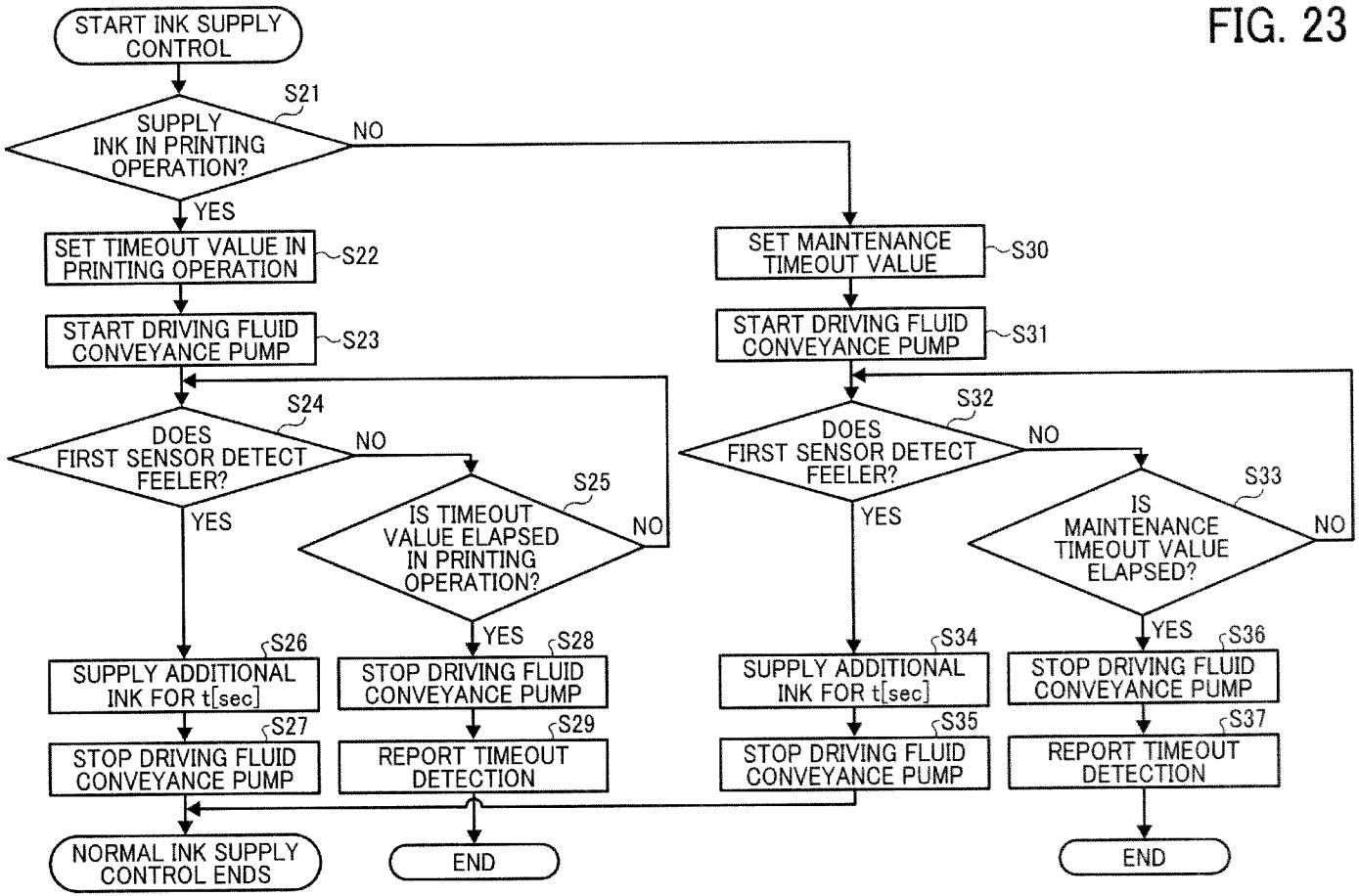
FIG. 23 is a flowchart illustrating an outline of an ink filling or supply control by the controller without using a second sensor according to the first embodiment of the present invention.

With reference to the flowchart in FIG. 23, the ink supply control without using the second sensor according to the first embodiment of the present invention will now be explained.

As described heretofore, when the ink remaining amount of the head tank 35 is reduced and the first sensor 251 detects the displacing member 205, and later, it is detected by the soft count that the ink consumption amount has reached the lower limit. As a result, this ink supply control has come to be started.

First, it is determined whether or not it is the ink supply in the printing operation (in step S21). This determination may be performed before the printing operation, not each time the ink supply is performed.

Herein, if the ink supply in the printing operation is performed, that is, when the ink supply is performed while consuming the ink inside the head tank 35, the first timeout threshold tout1 being the printing timeout value is set (S22). Thereafter, driving of the fluid conveyance pump 241 is started (S23).

Then, whether the first sensor 251 detects the displacing member 205 or not is determined (S24). At this time, if the first sensor 251 does not detect the displacing member 205 (No in S24), it is determined whether or not the printing timeout value has elapsed from when the driving of the fluid conveyance pump 241 was started (S25). If the printing timeout value has not elapsed yet (No in S25), the process returns to a determination on whether or not the first sensor 251 has detected the displacing member 205.

Then, if the first sensor 251 detects the displacing member 205 before the time corresponding to the printing timeout value has elapsed (Yes in S24), the fluid conveyance pump 241 is driven during the driving time t to supply ink corresponding to the difference amount (S26) and then the driving of the fluid conveyance pump 241 is stopped (S27), whereby the normal ink supply control ends.

By contrast, if the first sensor 251 does not detect the displacing member 205 before the time corresponding to the printing timeout value elapses, that is, the printing timeout value time has elapsed before the first sensor 251 has detected the displacing member 205 (Yes in S25), the driving of the fluid conveyance pump 241 is stopped (S28) and the timeout detection is reported (S29). The notification can be performed via a control panel of the image forming apparatus or the printer driver of the host apparatus.

Herein, if the ink supply in the printing operation is not performed, that is, when the ink supply is performed without consuming the ink inside the head tank 35 (corresponding to the maintenance time) (No in step S21), the maintenance timeout value or the second timeout threshold tout2 is set (S30). Thereafter, driving of the fluid conveyance pump 241 is started (S31). Herein, the maintenance time does not include the ink supply to the head tank 35 when ink suction from the nozzle of the recording head 34 is performed as a maintenance operation.

Then, whether the first sensor 251 detects the displacing member 205 or not is determined (S32). At this time, if the first sensor 251 does not detect the displacing member 205 (No in S32), it is determined whether or not the time corresponding to the maintenance timeout value has elapsed from the start of driving the fluid conveyance pump 241 (S33). If the maintenance timeout value time has not elapsed yet (No in S33), the process returns to a determination on whether or not the first sensor 251 has detected the displacing member 205.

Then, if the first sensor 251 detects the displacing member 205 before the time corresponding to the maintenance timeout value has elapsed (Yes in S32), the fluid conveyance pump 241 is driven during the driving time t to supply ink corresponding to the difference amount (S34) and the driving of the fluid conveyance pump 241 is stopped (S35), whereby the normal ink supply control ends.

By contrast, if the first sensor 251 does not detect the displacing member 205 before the time corresponding to the maintenance timeout value elapses, that is, the printing timeout value time has elapsed before the first sensor 251 has detected the displacing member 205 (Yes in S33), the driving of the fluid conveyance pump 241 is stopped (S36) and the timeout detection is reported (S37). The notification can be performed via the control panel of the image forming apparatus or the printer driver of the host apparatus.

Thus, before driving the fluid conveyance pump 241, whether the printing operation is performed (in which the ink supply includes ink consumption of the ink in the head tank) or the non-printing operation is performed (in which the ink supply does not include ink consumption of the ink in the head tank) is determined, and by setting a previously set predetermined timeout threshold tout [sec], an appropriate timeout value can be set without setting a uselessly long timeout threshold for the non-printing operation.

Specifically, as described above, in order to cope with the case in which ink supply is not performed properly, the driving of the fluid conveyance pump 241 is stopped when the second sensor 301 does not detect the displacing member 205 within a predetermined period of time from the start of the driving of the fluid conveyance pump 241.

If it is assumed that the supplied ink flow amount is the same, when the ink supply is performed in the non-printing operation, the ink inside the head tank increases in a short period of time compared to the ink supply in the printing operation. Then, if the timeout time in the non-printing operation is set to be the same as that in the printing operation, the uselessly long timeout period may be set.

Accordingly, in the present embodiment, by setting the second timeout threshold tout2 to shorter than the first timeout threshold tout1 in the printing operation (tout2<tout1), setting a uselessly long timeout threshold can be prevented and the more appropriate timeout threshold can be set, thereby securely preventing the damage of the apparatus due to the ink supply failure and the image quality degradation.

With reference to the flowchart in FIG. 24, the ink supply control without using the second sensor according to a second embodiment of the present invention will now be described, In the present embodiment, as the first timeout threshold tout1 in the printing operation (in which ink supply is performed while consuming the ink in the head tank 35), a timeout threshold tout1-1 and another timeout threshold tout1-2 are set.

The timeout threshold tout1-1 is a time at which printing operation is stopped when the elapsed time of the driving of the fluid conveyance pump 241 from the start of the driving reaches the timeout threshold tout1-1 before the first sensor 251 detects the displacing member 205.

If the printing operation is stopped by the above timeout threshold tout 1-1, ink supply continues without consuming the ink of the head tank 35. The timeout threshold tout1-2 is a time at which driving of the fluid conveyance pump 241 is stopped printing operation is stopped when the elapsed time of the driving of the fluid conveyance pump 241, from the start of the above state in which ink supply continues without consuming the ink of the head tank 35, reaches the timeout threshold tout1-2 before the first sensor 251 detects the displacing member 205.

The timeout threshold tout1-1 and the timeout threshold tout1-2 can be represented by following formulae (7) and (8):

[Formula 7]

$$\text{tout1-1[sec]}=C\text{[cc]}/(\text{Qave[cc/sec]}-\text{dmax[cc/sec]})+\alpha\text{[sec]} \quad (7)$$

[Formula 8]

$$\text{tout1-2[sec]}=(C\text{[cc]}-(\text{tout1-1[sec]}\times\text{Qmin[cc/sec]}-W\text{[cc]})/\text{Qmin[cc/sec]}+\alpha\text{[sec]} \quad (8)$$

In addition, the timeout threshold tout1-2 is obtained by subtracting the supplied ink amount by the minimum flow amount Qmin [cc/sec] and the cumulative ink discharge amount or the cumulative consumption amount W [cc] until the timeout threshold tout1-1 [sec] has elapsed from the ink supply amount C [cc] and the time to convey the remaining ink amount based on the minimum flow amount Qmin [cc/sec] of the fluid conveyance pump 241. In addition, a [sec] may be added taking into account the sensor detection error.

Figure 24:
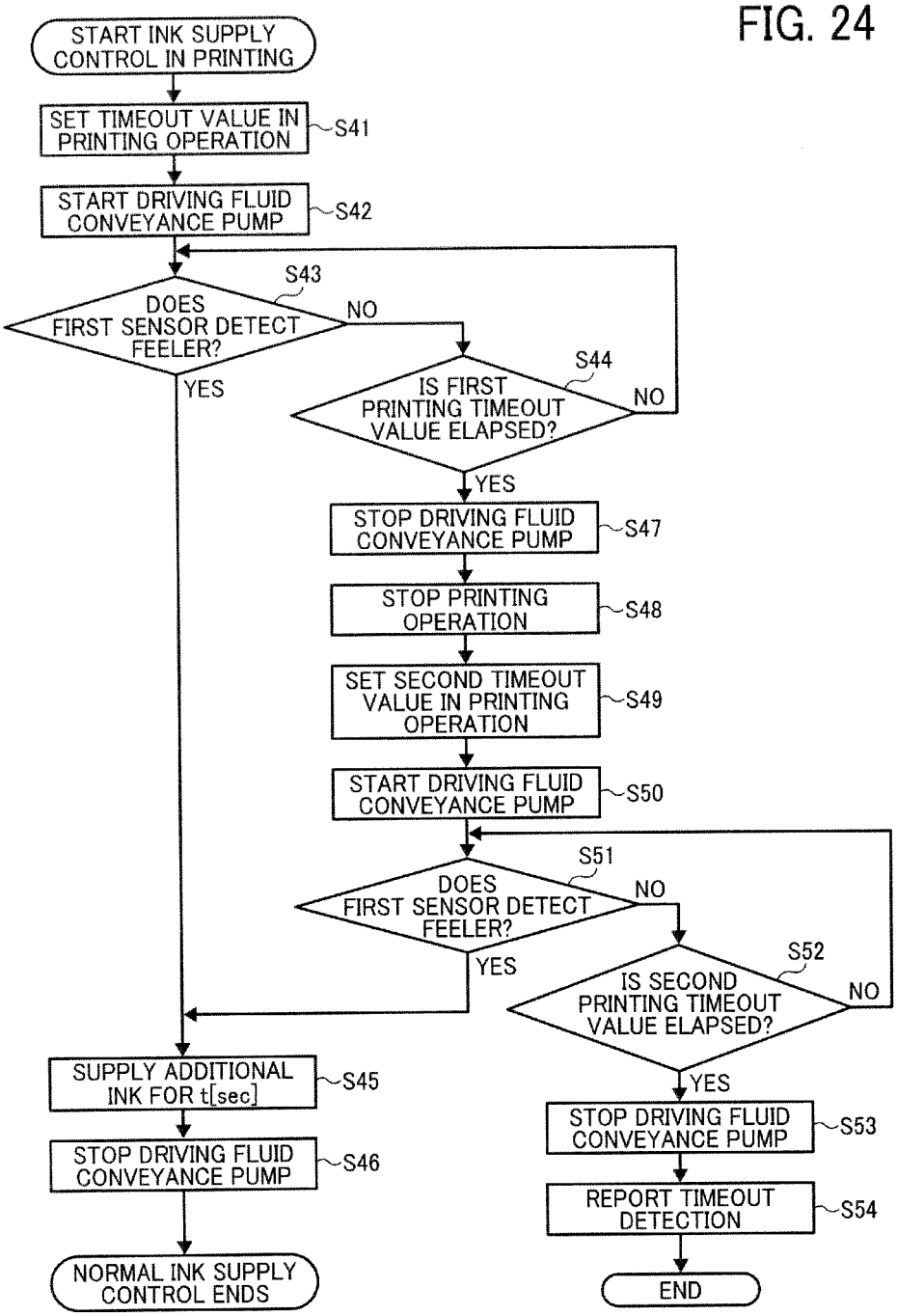
FIG. 24 is a flowchart illustrating an outline of an ink filling or supply control by the controller in the printing operation without using a second sensor according to a second embodiment of the present invention.

Then, referring now to FIG. 24, the ink supply control during printing operation is started. First, as the printing timeout value, the first printing timeout value (which equals to the timeout threshold tout1-1) and the second printing timeout value (which equals to the timeout threshold tout1-2) are set (in step S41). Thereafter, driving of the fluid conveyance pump 241 is started (S42).

Then, whether the first sensor 251 detects the displacing member 205 or not is determined (S43). At this time, if the first sensor 251 does not detect the displacing member 205 (No in S43), it is determined whether or not the first printing timeout value tout1-1 has elapsed from when the driving of the fluid conveyance pump 241 was started (S44). If the first printing timeout value tout1-1 has not elapsed yet (No in S44), the process returns to a determination on whether or not the first sensor 251 has detected the displacing member 205 (S43).

Then, if the first sensor 251 detects the displacing member 205 before the time corresponding to the first printing timeout value tout1-1 has elapsed (Yes in S43), the fluid conveyance pump 241 is driven during the driving time t to supply ink corresponding to the difference amount (S45) and then, the driving of the fluid conveyance pump 241 is stopped (S46), whereby the normal ink supply control ends.

By contrast, if the first sensor 251 does not detect the displacing member 205 before the time corresponding to the first printing timeout value tout1-1 elapses, that is, the printing timeout value time tout1-1 has elapsed before the first sensor 251 has detected the displacing member 205 (Yes in S44), the driving of the fluid conveyance pump 241 is stopped (S47) and further the printing operation is stopped (S48), Then, the second printing timeout value tout1-2 is obtained and set from the first printing timeout value and the cumulative ink discharge amount (or a cumulative consumption amount) W [cc] until the first printing timeout value is detected (S49), and the driving of the fluid conveyance pump 241 is started (S50). With this configuration, the ink supply is started without consuming the ink of the head tank 35.

Then, whether the first sensor 251 detects the displacing member 205 or not is determined (S51). At this time, if the first sensor 251 does not detect the displacing member 205 (No in S51), it is determined whether or not the second printing timeout value tout1-2 has elapsed from when the driving of the fluid conveyance pump 241 was restarted (S52). If the second printing timeout value tout1-2 has not elapsed yet (No in S52), the process returns to a determination on whether or not the first sensor 251 has detected the displacing member 205.

Then, if the first sensor 251 detects the displacing member 205 before the time corresponding to the second printing timeout value tout1-2 has elapsed (Yes in S51), the fluid conveyance pump 241 is driven during the driving time t to supply ink corresponding to the difference amount (S45) and then, the driving of the fluid conveyance pump 241 is stopped (S46), whereby the normal ink supply control ends.

By contrast, if the first sensor 251 does not detect the displacing member 205 before the time corresponding to the second printing timeout value tout1-2 elapses, that is, the second printing timeout value time has elapsed before the first sensor 251 has detected the displacing member 205 (Yes in S52), the driving of the fluid conveyance pump 241 is stopped (S53) and the timeout detection is reported (S54).

The printing ink supply control according to the present embodiment is in particular effective when the timeout threshold tout [sec] becomes long in the ink supply in the printing operation, because the ink supply flow amount Qmin [cc/sec] of the fluid conveyance pump 241 and the maximum ink discharge amount dmax [cc/sec] from the recording head 34 are similar levels and the ink is consumed while being supplied.

Specifically, when the ink supply and consumption is balanced, if the timeout threshold (or the first print timeout value) has elapsed in a state in which the first sensor 251 does not detect the displacing member 205, printing operation is temporarily stopped so that the ink discharge from the recording head 34 is stopped, and the ink supply is performed. If, in the above state, the first sensor 251 does not detect the displacing member 205 even though the timeout threshold tout1-2 or the second printing timeout value tout1-2 has elapsed, driving of the fluid conveyance pump 241 is stopped, thereby preventing securely any damage of the apparatus due to the ink supply failure and the image quality from degrading. By notifying the timeout detection, an abnormal state may be reported earlier.

With reference to the flowchart in FIG. 25, the ink supply control without using the second sensor according to a third embodiment of the present invention will now be described.

In the third embodiment, when the continuous printing operation is performed to a plurality of recorded media in the second embodiment, the printing operation is once stopped when the printing to the recorded medium has ended before the time corresponding to the first printing timeout value tout1-1 has elapsed even when the first printing timeout value time has not elapsed yet, and the process moves to a state in which ink is supplied to the head tank 35 without consuming the ink of the head tank 35. Then, in this state, when the second printing timeout value time has elapsed, the driving of the fluid conveyance pump 241 is stopped and the timeout detection is reported.

Figure 25:
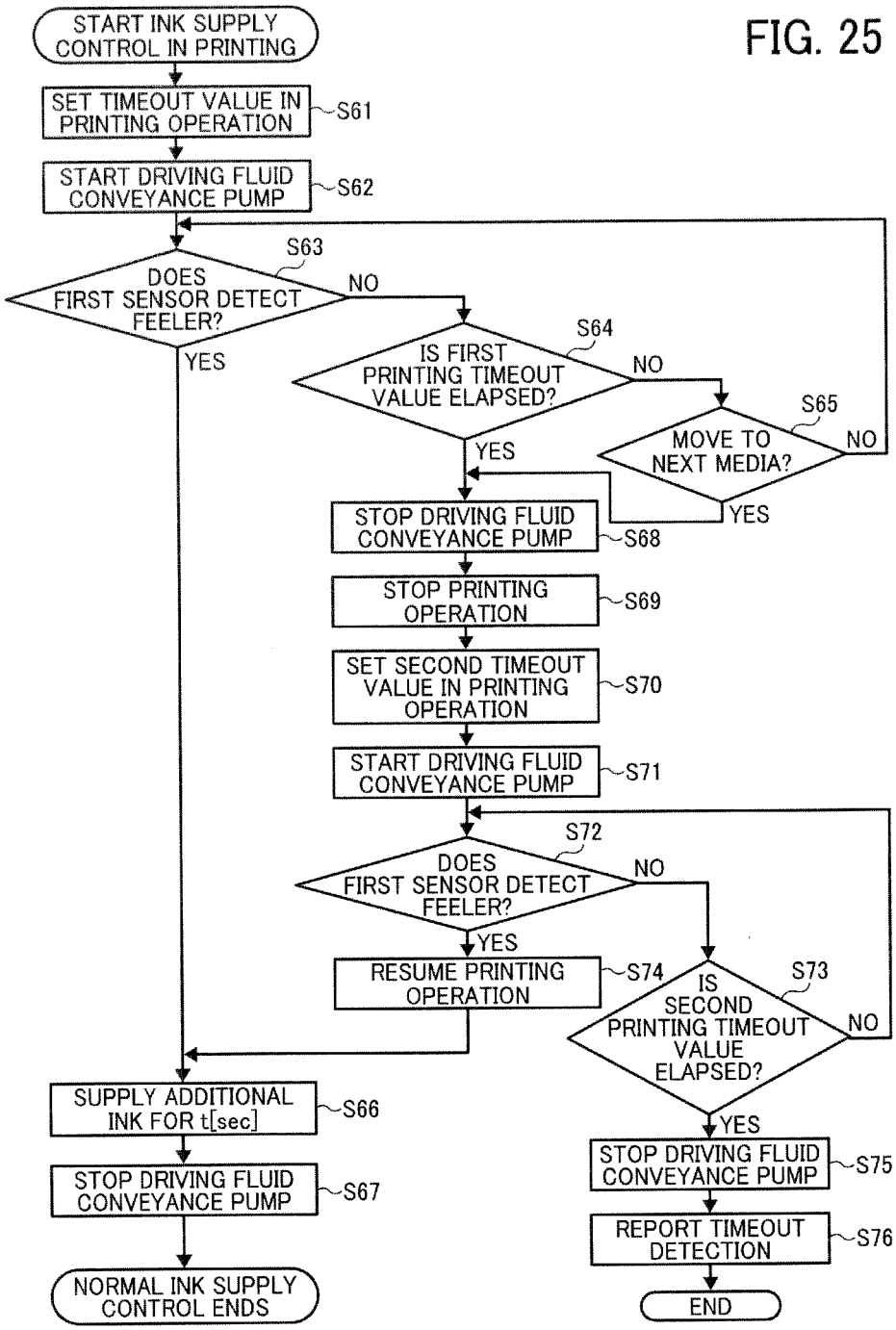
FIG. 25 is a flowchart illustrating an outline of an ink filling or supply control by the controller in the printing operation without using a second sensor according to a third embodiment of the present invention.
Figure 26:
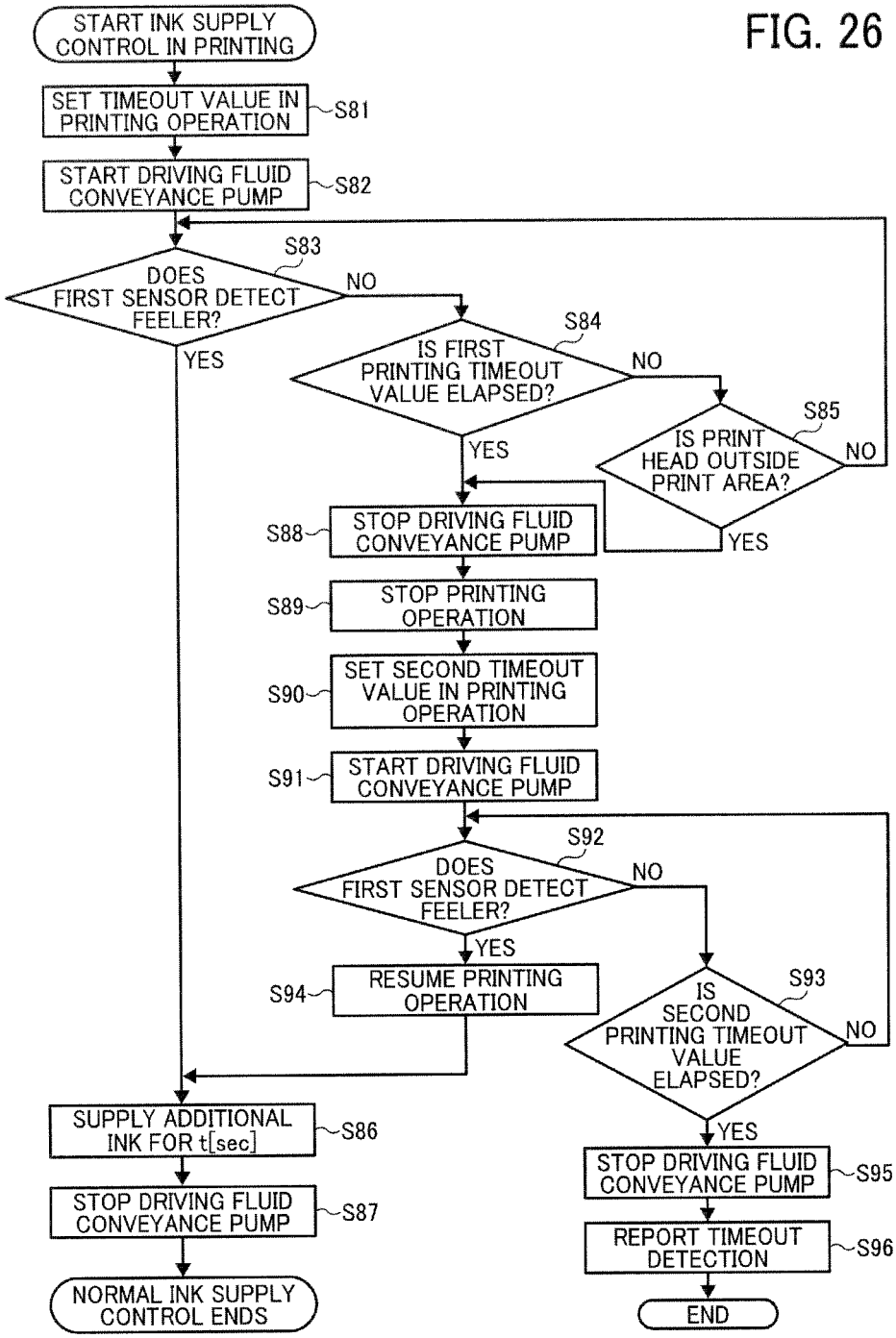
FIG. 26 is a flowchart illustrating an outline of an ink filling or supply control by the controller in the printing operation without using a second sensor according to a fourth embodiment of the present invention.

Specifically, as illustrated in FIG. 25, when the ink supply control in the printing operation is started, first, the printing timeout value is set (in step S61). Thereafter, driving of the fluid conveyance pump 241 is started (S62).

Then, whether the first sensor 251 detects the displacing member 205 or not is determined (S63). At this time, if the first sensor 251 does not detect the displacing member 205 (No in S63), it is determined whether or not the first printing timeout value tout1-1 has elapsed from when the driving of the fluid conveyance pump 241 was started (S64).

If the time corresponding to the first printing timeout value tout1-1 has not elapsed yet (No in SM), it is determined whether the process proceeds to the next printing medium (or the recorded medium) in step S65. If the process does not move to the next printing medium (No in S65), the process returns to a determination on whether or not the first sensor 251 has detected the displacing member 205.

Then, if the first sensor 251 detects the displacing member 205 before the time corresponding to the first printing timeout value tout1-1 has elapsed and before the process moves to the next printing medium (Yes in S63), the fluid conveyance pump 241 is driven during the driving time t to supply ink corresponding to the difference amount (S66) and then, the driving of the fluid conveyance pump 241 is stopped (S67), whereby the normal ink supply control ends.

By contrast, if the first sensor 251 does not detect the displacing member 205 before the time corresponding to the first printing timeout value tout1-1 elapses, that is, the first printing timeout value time has elapsed before the first sensor 251 has detected the displacing member 205 (Yest in SM), the driving of the fluid conveyance pump 241 is stopped (S68) and further the printing operation is stopped (S69). Then, the second printing timeout value tout1-2 is obtained and set from the first printing timeout value tout1-1 and the cumulative ink discharge amount (or a cumulative consumption amount) W [cc] until the first printing timeout value tout1-1 is detected (S70), and the driving of the fluid conveyance pump 241 is started (S71). With this configuration, the ink supply is started without consuming the ink of the head tank 35.

Then, whether the first sensor 251 detects the displacing member 205 or not is determined (in step S72). At this time, if the first sensor 251 does not detect the displacing member 205 (No in S72), it is determined whether or not the second printing timeout value tout1-2 has elapsed from when the driving of the fluid conveyance pump 241 was restarted (S73). If the second printing timeout value tout1-2 has not elapsed yet (No in S73), the process returns to a determination on whether or not the first sensor 251 has detected the displacing member 205.

Here, if the first sensor 251 detects the displacing member 205 before the time corresponding to the second printing timeout value tout1-2 has elapsed (Yes in S72), the printing operation is resumed (S74) and the fluid conveyance pump 241 is driven to supply ink corresponding to the difference amount (S66) and then, the driving of the fluid conveyance pump 241 is stopped (S67), whereby the normal ink supply control ends.

By contrast, if the first sensor 251 does not detect the displacing member 205 before the time corresponding to the second printing timeout value tout1-2 elapses, that is, the second printing timeout value tout1-2 time has elapsed before the first sensor 251 has detected the displacing member 205 (Yes in S73), the driving of the fluid conveyance pump 241 is stopped (S75) and the timeout detection is reported (S76).

In addition, when the printing operation moves to a next printing medium before the first sensor 251 detects the displacing member 205 and before the time corresponding to the first printing timeout value tout1-1 has elapsed, the same process as that when the first printing timeout value time has elapsed is executed before the first sensor 251 detects the displacing member 205.

Specifically, the fluid conveyance pump 241 is stopped and the printing operation is also stopped. Thereafter, driving of the fluid conveyance pump 241 is started. With this configuration, the ink supply is started without consuming the ink of the head tank 35.

Then, whether the first sensor 251 detects the displacing member 205 or not is determined. At this time, if the first sensor 251 does not detect the displacing member 205, it is determined whether or not the time corresponding to the second printing timeout value tout1-2 has elapsed from when the driving of the fluid conveyance pump 241 was restarted. If the second printing timeout value time has not elapsed yet, the process returns to a determination on whether or not the first sensor 251 has detected the displacing member 205.

Here, if the first sensor 251 detects the displacing member 205 before the time corresponding to the second printing timeout value tout1-2 has elapsed, the printing operation is resumed and the fluid conveyance pump 241 is driven to supply ink corresponding to the difference amount and then, the driving of the fluid conveyance pump 241 is stopped, whereby the normal ink supply control ends.

By contrast, if the first sensor 251 does not detect the displacing member 205 before the time corresponding to the second printing timeout value tout1-2 elapses, that is, the second printing timeout value time has elapsed before the first sensor 251 has detected the displacing member 205, the driving of the fluid conveyance pump 241 is stopped and the timeout detection is reported.

With the configuration as described above, even in the continuous printing operation, any damage of the apparatus due to the ink supply failure and image quality degradation can be securely prevented and an abnormal state may be reported earlier by notifying the timeout detection.

Herein, a case in which a plurality of recorded media is printed continuously is described, but in the continuous printing operation to a rolled sheet, the similar control can be performed by determining whether or not the printing to the predetermined image area, which corresponds to a sheet of recorded medium, has been completed.

Further, if the printing is performed continuously to the plurality of recorded media or the continuous sheet, when the printing mode is changed temporarily, it is preferred that the printing timeout threshold corresponding to each printing mode be set previously as described above, and that the printing timeout threshold be changed according to the change of the printing mode. With this setting, the more appropriate timeout threshold may be set, With reference to the flowchart of FIG, 26, the ink supply control without using the second sensor according to a fourth embodiment of the present invention will now be described.

In the fourth embodiment, when an ink supply is performed during the printing operation, the recording head 34 is moved to a non-printing area, At this time, when printing corresponding to a scanning of the carriage 33 has been completed, for example, when the carriage 33 is moved to the side of the second dummy discharge receiver 88 and a dummy discharge operation can be inserted during the printing operation, the printing operation is once stopped and an ink supply is performed in a state in which the recording head 34 is not allowed to discharge in, that is, in a state in which the ink of the head tank 35 is not consumed.

In this state, when the time corresponding to the second printing timeout value tout1-2 obtained from the first printing timeout value tout1-1 and the cumulative ink discharge amount (or a cumulative consumption amount) W [cc] until the first printing timeout value tout1-1 is detected has elapsed before the first sensor 251 has detected the displacing member 205, the driving of the fluid conveyance pump 241 is stopped and the timeout detection is reported.

The second printing timeout value tout1-2 to be used here is the one obtained by the above-described formula (8).

Then, as illustrated in FIG, 26, when the ink supply control in the printing operation is started, first, the first printing timeout value (which is the same as the timeout threshold tout1-1) is set as the printing timeout value (in step S81). Thereafter, driving of the fluid conveyance pump 241 is started (S82).

Then, whether the first sensor 251 detects the displacing member 205 or not is determined (S83). At this time, if the first sensor 251 does not detect the displacing member 205 (No in S83), it is determined whether or not the time corresponding to the first printing timeout value tout1-1 has elapsed from when the driving of the fluid conveyance pump 241 was started (S84).

If the time corresponding to the first printing timeout value tout1-1 has not elapsed yet (No in S84), it is determined whether the recording head 34 is outside the printing area (S85). If the recording head is not outside the printing area (No in S85), the process returns to a determination on whether or not the first sensor 251 has detected the displacing member 205.

Then, if the first sensor 251 detects the displacing member 205 before the time corresponding to the first printing timeout value tout1-1 has elapsed and before the recording head 34 is outside the printing area (Yes in S83), the fluid conveyance pump 241 is driven during the driving time t to supply ink corresponding to the difference amount (586) and then, the driving of the fluid conveyance pump 241 is stopped (S87), whereby the normal ink supply control ends.

By contrast, if the first sensor 251 does not detect the displacing member 205 before the time corresponding to the first printing timeout value tout1-1 elapses, that is, the first printing timeout value time has elapsed before the first sensor 251 has detected the displacing member 205 (Yes in S84), the driving of the fluid conveyance pump 241 is stopped (S88) and further the printing operation is stopped (S89). Then, the second printing timeout value tout1-2 is obtained and set from the first printing timeout value tout1-1 and the cumulative ink discharge amount (or the cumulative consumption amount) W [cc] until the first printing timeout value tout1-1 is detected (S90), and the driving of the fluid conveyance pump 241 is started (S91). With this configuration, the ink supply is started without consuming the ink of the head tank 35.

Then, whether the first sensor 251 detects the displacing member 205 or not is determined (S92). At this time, if the first sensor 251 does not detect the displacing member 205 (No in S92), it is determined whether or not the second printing timeout value tout1-2 has elapsed from when the driving of the fluid conveyance pump 241 was restarted (S93). If the second printing timeout value tout1-2 has not elapsed yet (No in S93), the process returns to a determination on whether or not the first sensor 251 has detected the displacing member 205.

Here, if the first sensor 251 detects the displacing member 205 before the time corresponding to the second printing timeout value tout1-2 has elapsed (Yes in S92), the printing operation is resumed (S94) and the fluid conveyance pump 241 is driven for the driving time t to supply ink corresponding to the difference amount (S86) and then, the driving of the fluid conveyance pump 241 is stopped (S87), whereby the normal ink supply control ends.

By contrast, if the first sensor 251 does not detect the displacing member 205 before the time corresponding to the second printing timeout value tout1-2 elapses, that is, the second printing timeout value time has elapsed before the first sensor 251 has detected the displacing member 205 (Yes in S93), the driving of the fluid conveyance pump 241 is stopped (S95) and the timeout detection is reported (S96).

In addition, before the first sensor 251 detects the displacing member 205 and before the time corresponding to the first printing timeout value tout1-1 has elapsed, when the recording head 34 is outside the printing area, the same process as that when the rust printing timeout value time has elapsed before the first sensor 251 detects the displacing member 205 is executed.

Specifically, the fluid conveyance pump 241 is stopped and the printing operation is also stopped. Thereafter, driving of the fluid conveyance pump 241 is started. With this configuration, the ink supply is started without consuming the ink of the head tank 35.

Then, whether the first sensor 251 detects the displacing member 205 or not is determined. At this time, if the first sensor 251 does not detect the displacing member 205, it is determined whether or not the second printing timeout value time has elapsed since when the driving of the fluid conveyance pump 241 was restarted. If the second printing timeout value time has not elapsed yet, the process returns to a determination on whether or not the first sensor 251 has detected the displacing member 205.

Here, if the first sensor 251 detects the displacing member 205 before the time corresponding to the second printing timeout value tout1-2 has elapsed, the printing operation is resumed and the fluid conveyance pump 241 is driven for the driving time t to supply ink corresponding to the difference amount and then, the driving of the fluid conveyance pump 241 is stopped, whereby the normal ink supply control ends.

By contrast, if the first sensor 251 does not detect the displacing member 205 before the time corresponding to the second printing timeout value tout1-2 elapses, that is, the second printing timeout value tout1-2 time has elapsed before the first sensor 251 has detected the displacing member 205, the driving of the fluid conveyance pump 241 is stopped and the timeout detection is reported.

With the configuration as described above, any damage of the apparatus due to the ink supply failure and image quality degradation can be securely prevented and an abnormal state may be reported earlier by notifying the timeout detection.

Next, a driving control of the fluid conveyance pump 241 will now be described in a case in which the ink supply is performed while the ink of the head tank 35 being consumed and a case in which the ink supply is performed while the ink of the head tank 35 not being consumed.

When the ink supply is performed when ink is not discharged from the recording head 34 and therefore the ink inside the head tank 35 is not consumed, the ink supply control operation can be completed in a short period of time. By contrast, when the ink supply is performed in the printing operation in which the ink inside the head tank 35 is being consumed, the ink supply control operation takes a longer period of time.

Therefore, in the ink supply during the printing operation, the ink supply is so controlled to increase the ink supply flow amount of the fluid conveyance pump 241 than that of the fluid conveyance pump 241 in the non-printing operation. With this configuration, the time for the ink supply control operation can be shortened.

In this case, the previously-set predetermined timeout threshold tout [sec] is preferably a value that takes into account the ink supply flow amount depending on the change of the driving control of the fluid conveyance pump 241. With such setting, any damage of the apparatus due to the ink supply failure and image quality degradation can be securely prevented and an abnormal state may be reported earlier by notifying the timeout detection.

Figure 27:
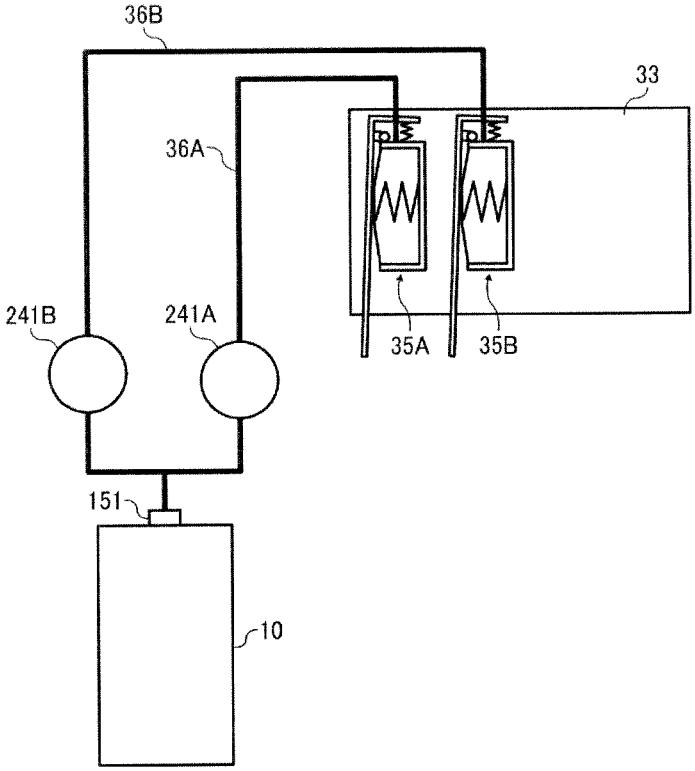
FIG. 27 is a schematic view illustrating an ink supply system according to a fifth embodiment of the present invention.

Next, a fifth embodiment according to the present invention will now be described with reference to FIG. 27. FIG. 27 is a schematic view illustrating an ink supply system according to the fifth embodiment of the present invention.

In the present embodiment, the image forming apparatus is configured to include two head tanks 35A and 35B to each of which a same color of ink is supplied form a main tank 10. The main tank 10 includes a supply port 151. Fluid conveying pumps 241A and 241B are disposed respectively on supply paths 36A and 36B between the supply port 151 and the head tanks 35A and 35B.

With the configuration as illustrated in FIG. 27, when the ink supply is performed to two head tanks 35A and 35B simultaneously, the driving control to the fluid conveyance pumps 241A and 241B is changed compared to a case in which ink supply is performed to either of the head tank 35A or 35B. For example, the current amount to be applied to the fluid conveyance pumps 241*a* and 241B is changed.

With such control, by driving the two fluid conveyance pumps 241A and 241B simultaneously, the ink supply flow amount to be supplied from the main tank 10 to the fluid conveyance pump 241 can be prevented from being reduced.

In this case, if the ink supply to either head tank 35 is ended and the ink supply to another head tank 35 is continued, the driving control to the fluid conveyance pumps 241A and 241B is again changed, for example, to reduce the current amount to be applied to the fluid conveyance pumps 241*a* and 241B.

With such an operation, without uselessly giving a load to the fluid conveyance pump 241, the ink supply flow amount can be maintained properly.

In this patent specification, the term "sheet" is not limited to the paper material, but also includes an OHP sheet, fabrics, boards, etc., on which ink droplets or other liquid are deposited. The term "sheet" is a collective term for a recorded medium, recording medium, recording sheet, and the like. The term "image formation" means not only recording, but also printing, image printing, and the like.

The term "image forming apparatus" means a device for forming an image by impacting ink droplets to media such as paper, thread, fiber, fabric, leather, metals, plastics, glass, wood, ceramics, and the like. "Image formation" means not only forming images with letters or FIGS. having meaning to the medium, but also forming images without meaning such as patterns to the medium (and impacting the droplets to the medium).

The "ink" is not limited to so-called ink, but means and is used as an inclusive term for every liquid such as recording liquid, fixing liquid, and aqueous fluid to be used for image formation, which further includes, for example, DNA samples, registration and pattern materials and resins, The term "image" is not limited to a plane two-dimensional one, but also includes a three-dimensional one, and the image formed by three-dimensionally from the 3D figure itself.

Further, the image forming apparatus includes, otherwise limited in particular, any of a serial-type image forming apparatus and a line-type image forming apparatus.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a recording head to discharge liquid droplets;

a head tank to contain a liquid to be supplied to the print head;

a carriage mounting the recording head and the head tank thereon;

a main tank to contain a liquid to be supplied to the head tank;

a fluid conveyance pump to convey the liquid from the main tank to the head tank;

a liquid supply control processor to control the liquid supply from the main tank to the head tank by driving the fluid conveyance pump;

a displacing member disposed at the head tank and configured to displace depending on a remaining amount of the liquid inside the head tank;

a first sensor disposed on the carriage and configured to detect the displacing member; and a second sensor disposed on the apparatus body and configured to detect the displacing member, wherein a first position is detected by the first sensor and a second position is detected by the second sensor and the remaining amount of the liquid in the head tank is smaller at the first position than at the second position; and wherein the liquid supply control processor is configured to:

detect and store a difference amount corresponding to a displacement amount of the displacing member between the first position detected by the first sensor and the second position detected by the second sensor;

measure a consumed liquid amount when the displacing member displaces from the first position detected by the first sensor in the direction in which the remaining liquid amount of the head tank is reducing when supplying the liquid from the main tank to the head tank without using the second sensor;

start the liquid supply upon the consumed liquid amount reaching a predetermined threshold so as to supply the difference amount after the first sensor has detected the displacing member; and stop the liquid supply when the first sensor does not detect the displacing member before a preset predetermined time has passed after the start of the liquid supply, when the liquid supply is performed from the main tank to the head tank without using the second sensor, wherein the preset predetermined time includes a first predetermined threshold time and a second predetermined threshold time, the first threshold time is the time in which the liquid supply from the main tank to the head tank is performed while consuming the liquid in the head tank and the second threshold time is the time in which the liquid supply from the main tank to the head tank is performed without consuming the liquid in the head tank, and the first threshold time is set longer than the second threshold time.

2. The image forming apparatus as claimed in claim 1, wherein the liquid supply control processor is configured to calculate a cumulative operation time of the fluid conveyance pump and determine whether or not the cumulative operation time has passed the predetermined threshold time.

3. The image forming apparatus as claimed in claim 1, wherein the first threshold time is changed based on a printing mode that changes the liquid supply amount discharged from the recording head.

4. The image forming apparatus as claimed in claim 1, wherein the first threshold time is changed based on a size of the recorded medium on which the recording head forms an image.

5. The image forming apparatus as claimed in claim 1, wherein the liquid supply control processor changes the first threshold time when a recorded medium on which the recording head forms an image is a continuous sheet and the printing mode is changed in the printing operation to the continuous sheet to the mode requiring a different liquid amount to be discharged from the recording head.

6. The image forming apparatus as claimed in claim 1, wherein in a continuous image forming operation to a plurality of recorded media, when the liquid supply is performed to the head tank while consuming the liquid inside the head tank, the liquid supply control processor is configured to control such that the image formation is interrupted when image formation to the recorded medium is completed before the first printing threshold time has elapsed;

the liquid supply to the head tank is stopped when the first detection sensor does not detect the displacing member before the second printing threshold time has not elapsed; and the first printing threshold time when the ink is supplied to the head tank while consuming the liquid in the head tank is set longer than the second printing threshold time when the ink is supplied to the head tank without consuming the liquid in the head tank.

7. The image forming apparatus as claimed in claim 1, wherein, when the liquid supply is performed to the head tank while consuming the ink in the head tank, if the recording head moves outside an image forming area before the first printing threshold time has elapsed, the image forming operation is stopped; and the liquid supply to the head tank is stopped when the first sensor does not detect the displacing member before the second printing threshold time has elapsed.

8. The image forming apparatus as claimed in claim 1, wherein driving control of the fluid conveyance pump is changed between in a case in which the liquid supply to the head tank is performed while consuming the ink in the head tank and in another case in which the liquid supply to the head tank is performed without consuming the ink in the head tank.

9. The image forming apparatus as claimed in claim 1, further comprising:

a plurality of head tanks connected to one main tank; and a plurality of fluid conveyance pumps disposed on each conveyance path communicating to each of the plurality of head tanks, wherein the driving control of the fluid conveyance pumps is changed between in a case in which the liquid supply is simultaneously performed to the plurality of head tanks and in another case in which the liquid supply is performed to one of the head tanks.

10. A liquid supply control method for an image forming apparatus, the image forming apparatus comprising:

a recording head to discharge liquid droplets;

a head tank to contain a liquid to be supplied to the print head;

a carriage mounting the recording head and the head tank thereon;

a main tank to contain a liquid to be supplied to the head tank;

a fluid conveyance pump to convey the liquid from the main tank to the head tank;

a liquid supply control processor to control the liquid supply from the main tank to the head tank by driving the fluid conveyance pump;

a displacing member disposed at the head tank and configured to displace depending on a remaining amount of the liquid inside the head tank;

a first sensor disposed on the carriage and configured to detect the displacing member; and a second sensor disposed on the apparatus body and configured to detect the displacing member, the method comprising the steps of:

detecting and storing a difference amount corresponding to a displacement amount of the displacing member between a first position detected by a first sensor and a second position detected by a second sensor;

measuring a consumed liquid amount when the displacing member displaces from the first position detected by the first sensor in the direction in which the remaining liquid amount of the head tank is reducing when supplying the liquid from the main tank to the head tank without using the second sensor;

starting the liquid supply upon the consumed liquid amount reaching a predetermined threshold so as to supply the difference amount after the first sensor has detected the displacing member; and stopping the liquid supply when the first sensor does not detect the displacing member before a preset predetermined time has passed when the liquid supply is performed from the main tank to the head tank without using the second sensor, wherein the preset predetermined time includes a first predetermined threshold time and a second predetermined threshold time, the first threshold time is the time in which the liquid supply from the main tank to the head tank is performed while consuming the liquid in the head tank and the second threshold time is the time in which the liquid supply from the main tank to the head tank is performed without consuming the liquid in the head tank, and the first threshold time is set longer than the second threshold time.

* * * * *